US010174457B2

(12) United States Patent
Lojewska et al.

(10) Patent No.: US 10,174,457 B2
(45) Date of Patent: Jan. 8, 2019

(54) MODIFIED NANOCOMPOSITE MATERIAL, METHOD FOR ITS PRODUCTION AND ITS APPLICATION

(71) Applicants: UNIWERSYTET JAGIELLONSKI, Cracow (PL); INSTYTUT INZYNIERII CHEMICZNEJ PAN, Gliwice (PL)

(72) Inventors: Joanna Lojewska, Cracow (PL); Tomasz Lojewski, Cracow (PL); Jacob L. Thomas, Gothenburg (SE); Roman J. Jedrzejczyk, Cracow (PL); Dominika Pawcenis, Cracow (PL); Barbara Gil, Cracow (PL); Jakub M. Milczarek, Lodz (PL); Katarzyna Turnau, Cracow (PL); Andrzej Kolodziej, Czekanow (PL)

(73) Assignees: Uniwersytet Jagiellonski, Cracow (PL); Instytut Inzynierii Chemicznej Pan, Gliwice (PL)

( * ) Notice: Subject to any disclaimer, the term of this patent is extended or adjusted under 35 U.S.C. 154(b) by 1 day.

(21) Appl. No.: 15/309,474

(22) PCT Filed: May 9, 2015

(86) PCT No.: PCT/IB2015/053408

§ 371 (c)(1),
(2) Date: Nov. 8, 2016

(87) PCT Pub. No.: WO2015/170303

PCT Pub. Date: Nov. 12, 2015

(65) Prior Publication Data

US 2017/0145638 A1 May 25, 2017

(30) Foreign Application Priority Data

May 9, 2014 (PL) ..... 408177
Feb. 27, 2015 (PL) ..... 411409

(51) Int. Cl.

| | |
|---|---|
| ***B65D 65/02*** | (2006.01) |
| ***B65D 65/38*** | (2006.01) |
| ***D21H 17/00*** | (2006.01) |
| ***D21H 17/63*** | (2006.01) |
| ***D21H 17/67*** | (2006.01) |
| ***D21H 17/69*** | (2006.01) |
| ***D21H 21/36*** | (2006.01) |
| ***D21H 27/10*** | (2006.01) |

(52) U.S. Cl.
CPC ..... *D21H 21/36* (2013.01); *B65D 65/02* (2013.01); *B65D 65/38* (2013.01); *D21H 17/63* (2013.01); *D21H 17/67* (2013.01); *D21H 17/69* (2013.01); *D21H 17/73* (2013.01); *D21H 27/10* (2013.01)

(58) Field of Classification Search
CPC ..... D21H 21/36; D21H 11/16; D21H 27/10; D21H 17/67; D21H 17/69; D21H 17/73; D21H 17/63; B65D 65/02; B65D 65/38
See application file for complete search history.

(56) References Cited

U.S. PATENT DOCUMENTS

| | | | | |
|---|---|---|---|---|
| 4,938,958 | A * | 7/1990 | Niira | A01N 59/16 424/617 |
| 5,492,741 | A * | 2/1996 | Akao | B32B 5/18 428/35.2 |
| 5,540,981 | A * | 7/1996 | Gallagher | B01J 23/10 257/13 |
| 5,981,052 | A * | 11/1999 | Sugiyama | C08K 9/08 252/1 |
| 6,355,330 | B1 * | 3/2002 | Koslow | A61F 13/15658 428/114 |
| 6,857,431 | B2 * | 2/2005 | Deevi | A24B 15/28 131/331 |
| 9,649,601 | B2 * | 5/2017 | Tang | B01D 71/028 |
| 2008/0305702 | A1 | 12/2008 | Nun et al. | |
| 2011/0027599 | A1 * | 2/2011 | Hoek | B01D 61/027 428/476.3 |
| 2011/0183007 | A1 | 7/2011 | Bilodeau et al. | |
| 2014/0141963 | A1 * | 5/2014 | Jones | C01B 39/04 502/68 |
| 2015/0321141 | A1 * | 11/2015 | Tang | B01D 71/022 96/6 |

(Continued)

FOREIGN PATENT DOCUMENTS

| | | | | |
|---|---|---|---|---|
| EP | 0826822 | A2 * | 3/1998 | C08K 9/08 |
| EP | 0938925 | A1 | 9/1999 | |

(Continued)

OTHER PUBLICATIONS

International Search Report and Written Opinion issued in corresponding International Patent Application No. PCT/IB2015/053408 dated Aug. 12, 2015 (10 pages).

*Primary Examiner* — Jose A Fortuna

(74) *Attorney, Agent, or Firm* — Kilyk & Bowersox, P.L.L.C.

(57) ABSTRACT

A nanocomposite material with antimicrobial properties, based on cellulose packed with a mineral filler (zeolite) exchanged with silver, characterised in that the mineral filler is made up of Y-type zeolites, while silver occurs in a form bound with the zeolite matrix in the form of cations and, optionally, nanoparticles of reduced silver, as well as a method for preparation of such a material and its application for the wrapping of plants, works of art, archives and antique objects, as well as food, pharmaceuticals and animal fodder.

16 Claims, 11 Drawing Sheets

(56) References Cited

U.S. PATENT DOCUMENTS

| | | | | |
|---|---|---|---|---|
| 2017/0145638 | A1* | 5/2017 | Lojewska | D21H 21/36 |
| 2017/0239600 | A1* | 8/2017 | Chen | B01D 39/02 |

FOREIGN PATENT DOCUMENTS

| | | | | | |
|---|---|---|---|---|---|
| JP | 2007268441 | A | * | 10/2007 | |
| WO | 0194512 | A1 | | 12/2001 | |
| WO | 2005123587 | A2 | | 12/2005 | |
| WO | 2006014446 | A1 | | 2/2006 | |
| WO | WO-2015170303 | A1 | * | 11/2015 | D21H 27/10 |

* cited by examiner

| Sample | Surface topography | Shape of grain edges |
|---|---|---|
| Z |  |  |
| Z_son_10 |  |  |
| Z-son_30 |  |  |

MODIFIED NANOCOMPOSITE MATERIAL, METHOD FOR ITS PRODUCTION AND ITS APPLICATION

This application is a National Stage Application of PCT/IB2015/053408, filed May 9, 2015, 2014, which claims priority to Polish Patent Application No. P.408177, filed May 9, 2014, and Polish Patent Application No. P.411409, filed Feb. 27, 2015, which are incorporated in their entireties by reference herein.

The invention relates to a cellulose-based modified nanocomposite material, a method for its production and its application. More particularly, the solution concerns: 1) a cellulose-based nanocomposite packaging material, of which the active material is made up of a zeolite with nanoparticles of metallic silver embedded into its structure and silver cations in a form bound with the zeolite matrix and dispersed in it; 2) a method for production of the nanocomposite packaging material, with the method containing an additional step of sonication of the zeolite exchanged with silver cations, leading to their partial reduction, as well as 3) application of the nanocomposite material for wrapping of works of art, archives and antique objects, as well as food, plants, pharmaceuticals and animal fodder.

Scientific literature indicates that silver nanoparticles have both biostatic and biocidal properties, with simultaneously questioned toxicity (compared to other transition metals) towards higher organisms.

European Patent No. EP 0297538 B1 (published on 29 Jun. 1988) discloses a film containing a zeolite with biocidal (antibiotic) properties. The patent describes a zeolite containing a polymer film with biocidal properties, where the zeolite content is minimised. The film is applied onto at least one side of a polymer carrier.

International publication No. WO 2006/046837 Al (published on 4 May 2006) discloses a method for preparation of zeolite-fibre composite substrates. The application describes a method for preparation of zeolite-fibre composites, and its successive steps comprise a reaction of fibres or a zeolite with a bonding substance in order to form an intermediate compound. Then, a reaction between the intermediate compound and the remaining zeolite or fibres using sonication is carried out, in order to obtain the composite material.

European Patent No. EP 0270129 B1 (published on 12 Dec. 1987) discloses a biocidal (antibiotic) zeolite. The patent describes a biocidal zeolite and a resin containing a zeolite or a biocidal zeolite. All natural and synthetic zeolites were described, being exchangeable with silver ions (0.1-15%), copper and/or zinc ions (0.1-8%) and ammonium ions (0.5-15%). Other heavy metals may also be exchanged in the zeolite, and the described resins include the entire set of thermosetting and thermoplastic resins.

International publication No. WO 01/94512A1 discloses a method for partial exchange (in the amount of 2-40% by wt.) of metal atoms (M) of a zeolite with the formula $M_2/n*Al_2O_3*xSiO_2*yH_2O$ by a metal of groups III and IV, and Mg, Ti, Cr, Fe, Ni, Cu, Zn, Zr, Ag, the metal being mixed with the zeolite in the form of an aqueous solution of a salt of this metal, and the pH of the solution is in the range of 4-10.

International publication No. WO 2007037195A1 describes an antibacterial zeolite, in which the exchangeable ions are partially or completely replaced by hydrogen and silver ions. The solution pertains to a material based on a resin packed with zeolite in its hydrogen form, exchanged with silver cations.

Publication No. TW 201215561 A discloses a zeolite with modified mechanical properties extending its life. The zeolite was exchanged with copper and silver cations in order to decrease its production costs while maintaining its microcidal properties, which are similar to those of pure silver. The modification consists in an optimisation of the Si:Al ratio and application of structural additives in the form of zirconium phosphate and gelling agents.

Chinese Patent Application No. CN 102452664 A relates to a zeolite material with a structure modified by additions of ash, zirconium phosphate and refractory mortar and by an optimisation of the Si:Al ratio in the zeolite itself. The zeolite contains silver and copper ions in order to maintain similar microbiocidal properties with lower costs.

Techniques offered in the market are also known—MicroChamber and Artcare paper products containing in their structure zeolites, which may remove exo- and endogenic gas impurities for the microenvironment of antique objects. However, the MicroChamber-type paper comprises no zeolites containing exchangeable metals or metallic nanoparticles in its structure. Also, paper of such a type does not exhibit any antimicrobial activity.

EKOPAK-plus manufactures packaging with a special coating of silver nanoparticles. This coating protects products from microbial growth (bacteria, viruses and fungi) during transport and storage. Nanosilver inhibits enzymatic processes of bacteria and contributes to formation of active oxygen in water and air, efficiently preventing the growth of microbes.

The basic problem in the use of biocidal properties of silver is a migration of its nanoparticles into the protected object (food, organisms). The harmfulness of the nanoparticles on the biosphere is still being scientifically discussed, and the content of silver nanoparticles in food and packaging is not currently regulated either in the European Union or in the United States of America. However, recent reports in the literature indicate the harmfulness of nanosilver for cells of higher organisms, resulting from the penetration of silver into the mitochondria.

As is apparent from cited literature reports and the state of art, there is still a need for intense works on the search for packaging materials which would differ by many features from those currently available, including having a multifunctional character, as well as properties limiting the migration of silver particles from the packaging to the packed object.

BRIEF DESCRIPTION OF THE DRAWINGS

FIGS. 9A-9D were obtained at various temperatures under He flow for a sample of FIG. 9A the sonicated Y-type zeolite (ZAg0__EDTA), FIG. 9B the non-sonicated Y-type zeolite (ZAg+__EDTA). FIGS. 9C and 9D spectra are magnifications of FIGS. 9A and 9B spectra, respectively, in the range of carbonyl group vibrations.

FIGS. 10A and 10B are in situ FTIR (DRIFT) spectra of conversion of the adsorbed acetic aldehyde obtained at various temperatures under the flow of air for a sample of FIG. 10A the sonicated Y-type zeolite (ZAg0_EDTA), FIG. 10B the non-sonicated Y-type zeolite (ZAg+_EDTA) shown in the range of carbonyl group vibrations.

FIG. 11A is for the experiment without air, FIG. 11B is for the experiment under the flow of air (in this case, the results obtained in the experiment without air was used as $\mathbf{1}_{25}$ considering the immediate reaction of the aldehyde).

Figure 1:
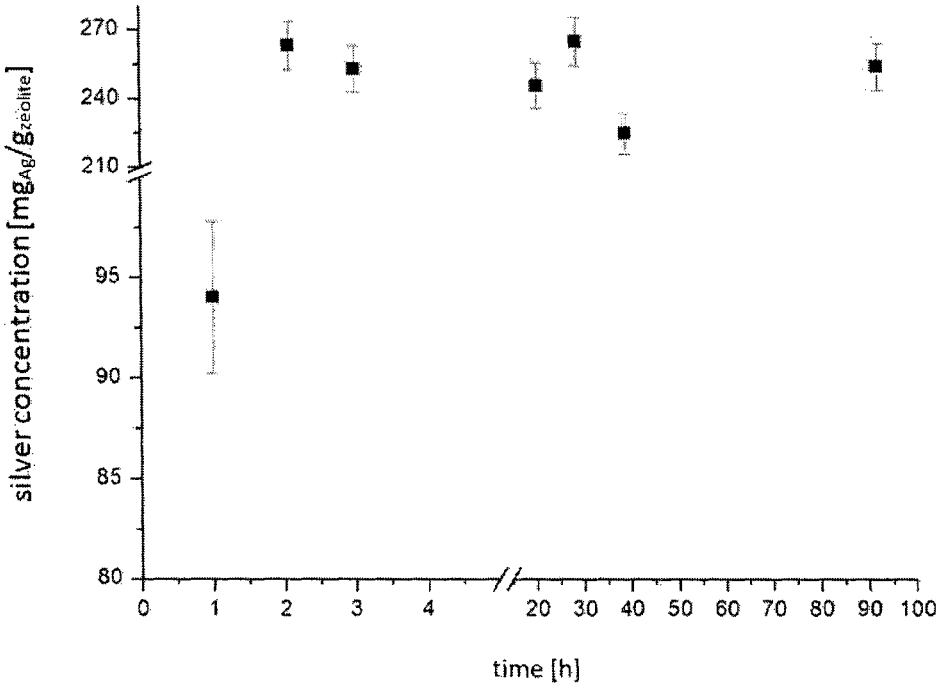
FIG. 1 is a graph showing the quantitative characteristics of the exchange of silver cations in the zeolite in the form of an ion exchange isotherm created on the basis of X-ray fluorescence (XRF) analyses of the silver content in the zeolite.

The goal of the invention is to provide packaging material with high biocidal activity and sorption and catalytic properties, with a minimum content of silver introduced into the zeolite, the silver being in a dispersed state in the channels and cavities of the zeolite in the form of clusters or atoms of metallic silver particles and silver cations in order to prevent their migration. The formation of silver in two oxidation states in the zeolite is to ensure the catalytic activity of the material. The goal of the invention is also to provide a method for obtaining of such a material having the aforementioned features.

The present invention relates to a method for manufacturing of a nanocomposite packaging material, comprising the substitution of a zeolite matrix with silver(I) ions, addition of an active material in the form of a zeolite matrix containing silver to a cellulose suspension and its deposition on cellulose fibres, formation of the paper pulp into a desired shape and drying, characterised in that before the addition of the zeolite matrix exchanged with silver ions to the cellulose suspension, the zeolite is rinsed with an aqueous solution of disodium salt of ethylenediaminetetraacetic acid (EDTA), wherein the rinsing with EDTA preferably comprises the following steps: a) rinsing of the zeolite with 0.01 M EDTA at room temperature; b) washing with 0.01 M EDTA for one hour at boiling temperature; c) rinsing of the zeolite with 0.1 M EDTA solution and d) flushing of the zeolite with deionised water.

Preferably, the zeolite matrix is treated with a silver nitrate solution in order to introduce silver into it.

In a preferred variant, sonication of the zeolite matrix exchanged with silver ions is additionally carried out before washing with EDTA, preferably for 10 minutes in a suspension of the zeolite with an average power of 90 W and at a temperature of the solution below 60° C.

A further object of the invention is a nanocomposite material comprising cellulose packed with the silver-containing zeolite, characterised in that a Y-type zeolite is the mineral filler, whereas silver occurs in a form bound with the zeolite matrix in the form of silver cations, silver content is in the range of 1-2% by wt., and the material also exhibits sorptive and catalytic properties apart from antimicrobial properties. Such a material is obtained using a variant of the method according to the invention carried out without sonication.

A further object of the invention is a nanocomposite material containing cellulose packed with the silver-containing zeolite, characterised in that a Y-type zeolite is the mineral filler, whereas silver occurs in a form bound with the zeolite matrix in the form of silver cations and metallic silver nanoparticles, preferably in a ratio of 1:1, whereas the total silver content in the zeolite does not exceed 1% by wt. Preferably, metallic silver occurs in the zeolite beside silver cations in the result of application of a sonication procedure.

Preferably, the silver ions were introduced into the structure of the zeolite by ion exchange. Preferably, the zeolite matrix does not contain silver in its non-bound form in the form of silver oxide clusters. Preferably, the material according to the invention exhibits sorptive properties towards volatile organic compounds and gaseous impurities, and catalytic properties in the oxidation of volatile organic compounds at room temperature in air and at a temperature of 60° C. without air access. Equally preferably, the material according to the invention exhibits bactericidal and fungicidal properties, particularly against *Escherichia coli, Serratia marcescens, Bacillus subtilis* and *Bacillus megatherium* bacteria, and/or *Trichoderma viride, Chaetomium globosum, Aspergillus niger, Cladosporium cladosporides* and *Morterella alpinum* fungi.

A further object of the invention is the application of the nanocomposite material according to the invention, defined above, for wrapping, particularly for wrapping of plants, works of art, archives and antique objects or for the wrapping of food, pharmaceuticals and animal fodder.

In a particular embodiment, the present invention relates to a nanocomposite material with sorptive, catalytic and antimicrobial properties. The material is obtained from paper pulp packed with a Y-type zeolite, having clusters or atoms of metallic silver trapped in its structure, so as they do not migrate to the exterior of the material. Moreover, the present invention relates to a method for production of the modified zeolite exchanged with silver cations, and then flushed with an EDTA solution in order to remove silver not bound with the zeolite matrix, using sonication, leading to a reaction of silver and a refinement of the zeolite while preserving its structure. The material being the subject of the invention may find application as a packaging material for the storage of works of art, archives and antique objects, as well as plants, food, pharmaceuticals and animal fodder.

The first aspect of the invention is a multifunctional nanocomposite material based on cellulose packed with a zeolite with clusters or atoms of metallic silver and silver cations trapped in the structure of the zeolite's channels and cavities, the material exhibiting antimicrobial, sorptive and catalytic properties, which may be used, among others, for the wrapping of plants (living and cut flowers), food and pharmaceuticals, animal fodder, works of art and antique objects or as an insulation material.

Another aspect of the invention relates to a method for production of the material according to the invention. According to the invention, a Y-type zeolite (a mesoporous material- with a faujasite structure), used as a carrier for silver, is applied for the modification of cellulose. During the ion exchange of the sodium zeolite form, sodium cations are exchanged with silver cations (bound state of silver); however, the deposition of silver oxide crystallites on the external surface of the zeolite (non-bound state of silver) is also possible. In the first step, after treatment with the solution of a silver salt, both the bound state of silver in the form of cations and the non-bound state in the form of crystallites (clusters) of its oxide occur in the zeolite. Elimination of silver in the form of clusters from the surface of the zeolite is then carried out until a pure zeolite exchanged with silver cations is obtained, i.e. a material with silver in its bound form, with minimum silver content. In the next step, sonication of the so-prepared material is carried out in order to reduce silver cations to metallic silver in the form of atoms or clusters, so as to obtain defined contents of both forms of silver in the final product. Considering the fact that this process is carried out in the interior of the zeolite, the obtained silver atoms or nanoparticles are trapped in it, resulting in a reduced risk of contamination of the packed products and the external environment with silver.

Sonicators are commonly used in the chemical industry for modification of chemical properties of materials or for chemical synthesis. The approach to the engineering of the materials shown in the invention enables uniform distribution and high dispersion of the zeolite in the paper material for the sake of i) application of the zeolite exchanged with silver on an atomic scale, permanently bound with the zeolite matrix thanks to flushing with EDTA, ii) sonication leading to a dispersion of the zeolite and reduction of the silver cations contained in it, as well as iii) a method for manufacturing of paper sheets with zeolite packing.

The modified zeolite used in the present invention exhibits the ability to absorb gases, and it has proved useful as a component of other products, performing as a material reducing the concentration of volatile organic compounds (VOC) and other gases connected with unpleasant odours, e.g. forming as the result of degradation of the materials being stored. Moreover, silver in its dispersed state inside zeolites is a catalyst of VOC oxidation, which has been proven in the example of acetic aldehyde oxidation. Surprisingly, it was found that in order to obtain catalytic activity of silver at low temperatures, particularly room temperature, the presence of both a reduced form of metallic silver and that of its cations is necessary. Catalytic activity of the material is observed at low temperatures even without air access to the material. Thus, the present invention is a novelty when compared to other cellulose materials containing zeolites, because of the fact that while using it, undesirable organic gases may be removed both by their sorption and catalytic decomposition.

The basic component for production of the material according to the invention is made up of paper pulp, which may be easily prepared in large amounts and formed into two- and three-dimensional objects, such as: paper, paperboard, containers, etc., using known industrial processes, or suspended in a liquid and applied as a spray, as well as dried and blown into isolated spaces. Cellulose fibres have micro- and mesopores and voids, as well as a polar surface, thanks to which they may bind and hold the zeolite particles.

Paper packed with the prepared zeolite, constituting a particular embodiment of the invention, has proven biostatic and biocidal properties both against bacteria and fungi. Moreover, it is characterised by sorptive properties towards both VOC and gaseous impurities such as $SO_2$ or $NO_x$. Catalytic activity of the obtained material in oxidation of VOC at low temperatures without air access was also demonstrated.

The invention has a series of unexpected advantages in comparison to similar solutions known from the state of art.

Particularly, in the present invention, silver occurs not only in the form of cations exchanged in the zeolite, but also in the form of atoms or nanoparticles trapped in the structure of the zeolite. Thanks to this fact, the catalytic properties of the material were improved, and the material oxidises volatile organic compounds already at room temperature, and even partially without air access. A high dispersion of the material was also obtained, additionally contributing to the improvement of catalytic activity. On the other hand, the silver content was reduced to an amount below 1% by wt.

Application of zeolites has a stabilising influence on silver, being the active component of the entire material. In particular, one should take into account the reduction of migration of the silver nanoparticles (contained in the packaging material) to objects or substances stored in this packaging.

The invention described in this application differs fundamentally from the products of the state of art, because of the fact that the proposed material is a multifunctional paper product adsorbing impurities and exhibiting antimicrobial and catalytic properties thanks to the application of zeolites with silver in two oxidation states. In the present embodiment, zeolite aggregates with silver cations and atoms or clusters of silver trapped in their structure are immobilised on purified cellulose fibres using chemical and physical sorption methods in order to form the composite zeolite-fibre material. Using filtration and sedimentation methods, it is possible to produce a composite material consisting of a zeolite-fibre component enriched with a layer of functionalised zeolites.

The invention should find application in the field of preservation of works of art and antique objects. The developed material may be a part of paperboard elements in contact with a work of art, particularly in the case of mounts which will be in contact with the external walls of buildings. In winter, the external walls, particularly in poorly insulated buildings, such as historic houses or churches, may have a low temperature, leading to the formation of a humid microclimate inside the building. This is a particularly dangerous situation in spaces behind and between the objects of interest, where the risk of growth of mould increases. The present invention, prepared in the form of paperboard and used as a mounting support or rear wall for an object in a frame, may serve as a prophylactic tool inhibiting the growth of mould. As a result of increased humidity, water bridges between the paperboard and the object in question will form, which should additionally improve the biostatic effect. Another application in this group may consist in a material for wrapping materials of organic origin (cloth, leather, parchment, paper, wood, fossils, etc.), which are also susceptible to microbial attack. Absorbent paper may also be prepared and delivered as a system ready to use in the case of disasters such as flood or inundation. In the case of such disasters or malfunctions, wet objects are often wrapped in absorbent paper and tissues prior to vacuum packing. In the next step, the objects are stored at a low temperature, stopping or significantly hindering microbial growth. In such a case, the present invention would provide a possibility for additional antimicrobial protection. In all described cases, the sorptive properties of the present invention are of importance, too. For storage of archival materials or library collections, boxes or envelopes with such catalytic, sorptive and biocidal properties may be used.

While preserving works of cultural importance, it is necessary to separate them from the influence of harmful gaseous air impurities, e.g. acidic gases present in urban agglomerations at high concentrations ($NO_x$, $SO_2$, $CO_2$), as well as to remove gaseous products of degradation of the object, often having a destructive influence on the object, from the atmosphere surrounding the object. The undesirable influence of microbes (fungi and bacteria) on works of art is known and has been repeatedly described in literature.

As a packaging protecting antique and archival objects, the present invention is currently the only known product having fungicidal and bactericidal properties, as well as biostatic and sorptive properties, simultaneously. Stabilising properties, multifunctionality, application of renewable materials, simple and scaleable production methods and a "green chemistry"-consistent approach differentiate the presented invention from other products commercially available on the market.

The developed packaging material was subjected to comprehensive physicochemical studies. It was shown in their results that, among others, both silver cations and metallic silver in the form dispersed in the zeolite are permanently bound with the zeolite and do not penetrate into the environment, and this fact is of high importance because of the stability of the biostatic properties of the material and safety of its use. Tests for the presence of silver in the aqueous filtrate which was in contact with the developed material (the sample denoted as P_ZAgO was used) yielded a negative result—both at low and high temperatures, neither silver ions nor silver nanoparticles were extracted to water, which was confirmed by chloride ions test and XRF analyses.

The transfer of silver nanoparticles and silver ions during contact with model food may be checked using proper analytical techniques. In the investigations carried out by the authors using the XRF technique, no presence of silver was found in nutrient agar remaining in prolonged contact with silver-containing paper disks.

Moreover, it was proven that thanks to use of sonication and obtaining silver at two oxidation states in the zeolite matrix, the material exhibits catalytic activity in combustion of volatile organic compounds at room temperature even without air access, and this has a significant biocidal activity. This was confirmed using sorption and catalytic tests carried out in situ with the analysis of the intermediate products by DRIFT/FTIR. Thanks to sonication, a high granularity of the material was obtained, possibly also contributing to its exceptional catalytic activity. The silver content in the material was reduced below 1%.

The results of microbiological tests confirm the high activity of the material against the strains of bacteria and fungi typically occurring in food or archives, however this activity is comparable to that of the non-sonicated material containing silver cations only.

Figure 2:
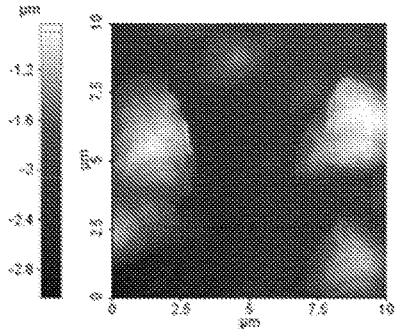
FIG. 2 are a series of micrographs showing the results of topographic analyses of the zeolite material subjected to sonication by atomic force microscopy (AFM) (topographic AFM maps (the first column) and crystallite edge distribution obtained by the no-contact method (the second column) of the Y-type zeolite samples subjected to sonication.
Figure 2:
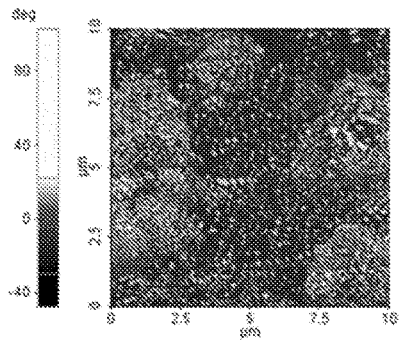
Figure 2:
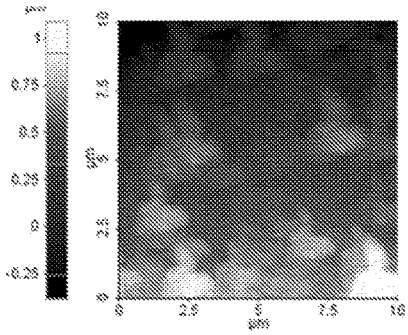
Figure 2:
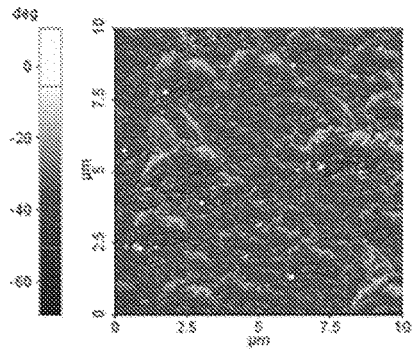
Figure 2:
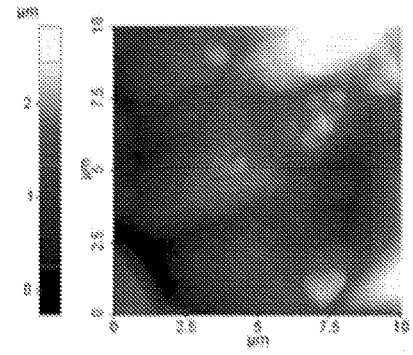
Figure 2:
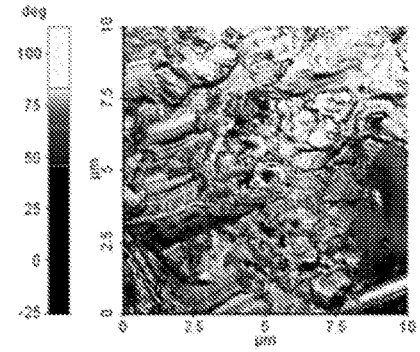
Figure 3:
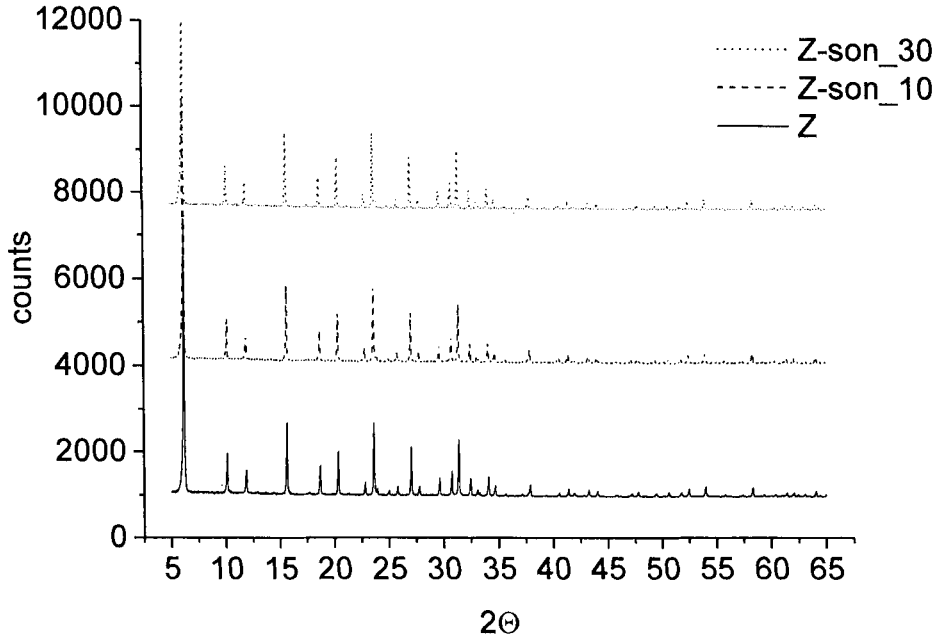
FIG. 3 is a graph (diffractogram) and shows the results of diffractometric analyses of samples of the zeolites subjected to sonication.
Figure 4:
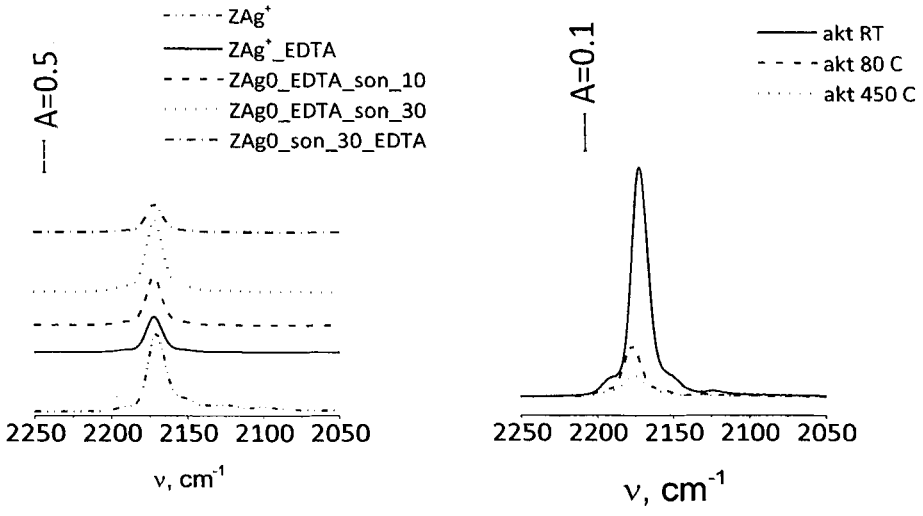
FIG. 4 is an infrared spectroscopy and shows the results of quantitative and qualitative analyses by in situ infrared spectroscopy (in situ FTIR) for sorption of CO on zeolite materials subjected to sonication and on reference materials (a) FTIR spectra of carbon monoxide adsorbed on $Ag^+$ions in the studied samples of the Y-type zeolite; b) A comparison of the conditions of zeolite activation.
Figure 5:
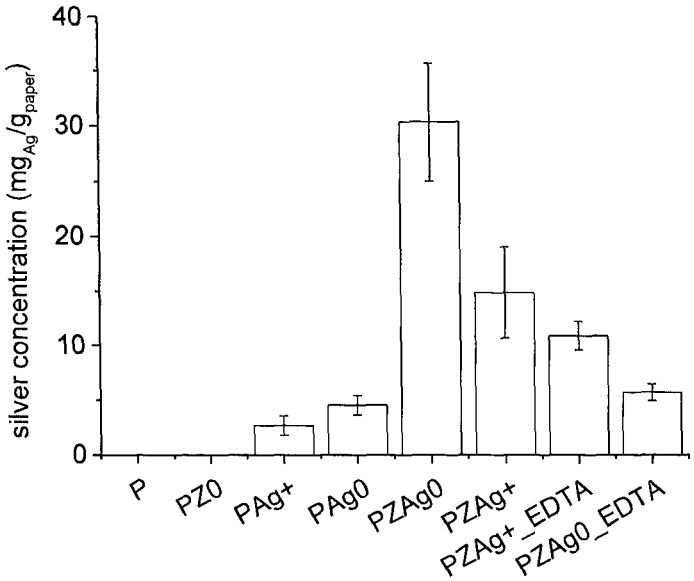
FIG. 5 is a bar graph that shows the results of analyses of the silver content in the paper material packed with the sonicated zeolite.
Figure 6:
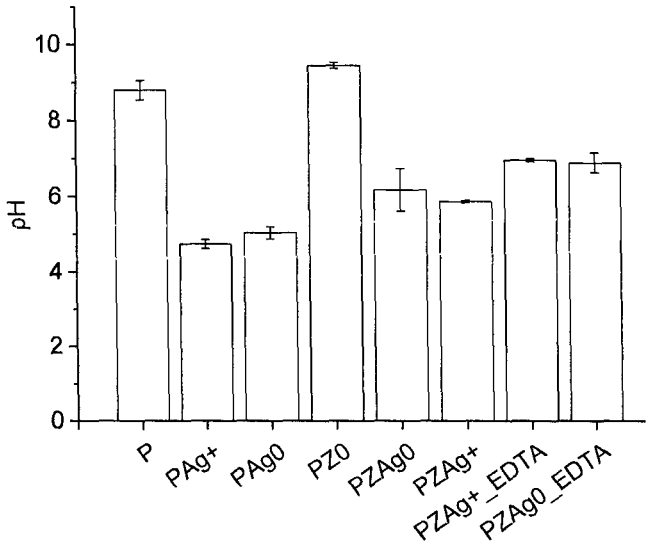
FIG. 6 is a bar graph that shows the characteristics of the paper material packed with the zeolite and the stability of the paper material determined by the pH measurements of samples in various stages of preparation and reference samples.
Figure 7:
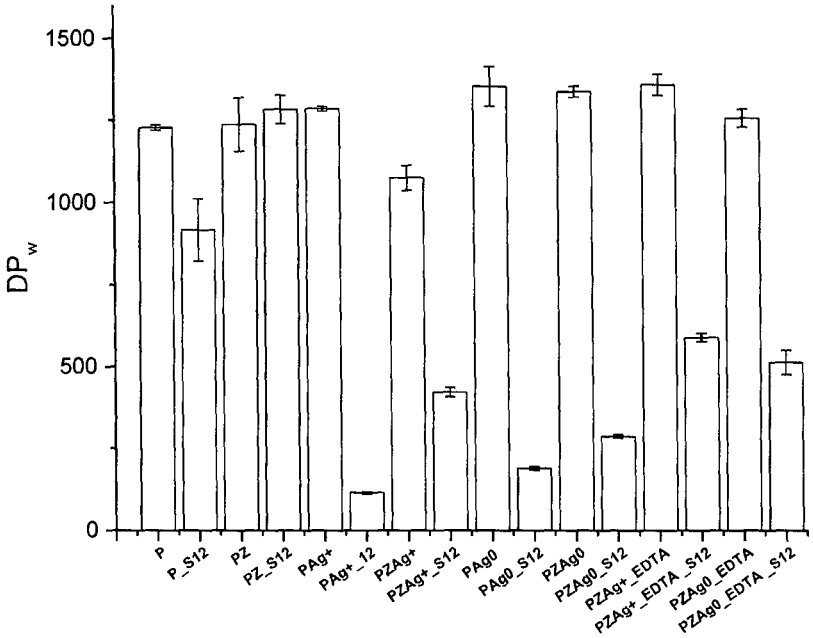
FIG. 7 is a bar graph that shows the characteristics of the paper material packed with the zeolite and the stability of the paper material after ageing tests carried out according to the ASTM standard and expressed as the degree of polymerisation (DP) of cellulose.
Figure 8:
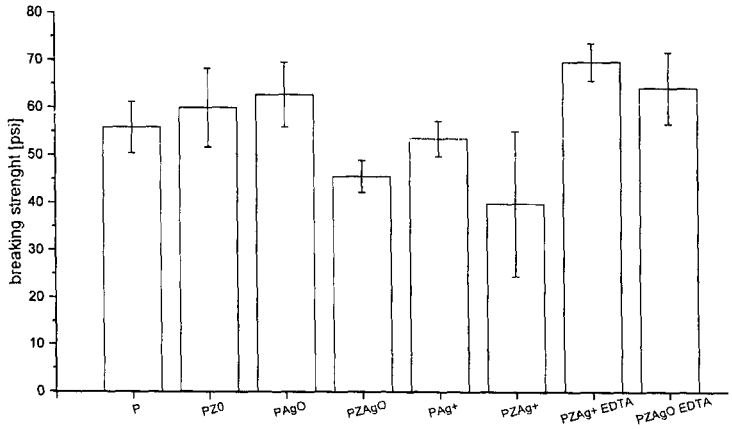
FIG. 8 is a bar graph that shows the characteristics of the paper material packed with the zeolite and the stability of the paper packed with the Y-type zeolite expressed as zero-span breaking strength.
Figure 9A:
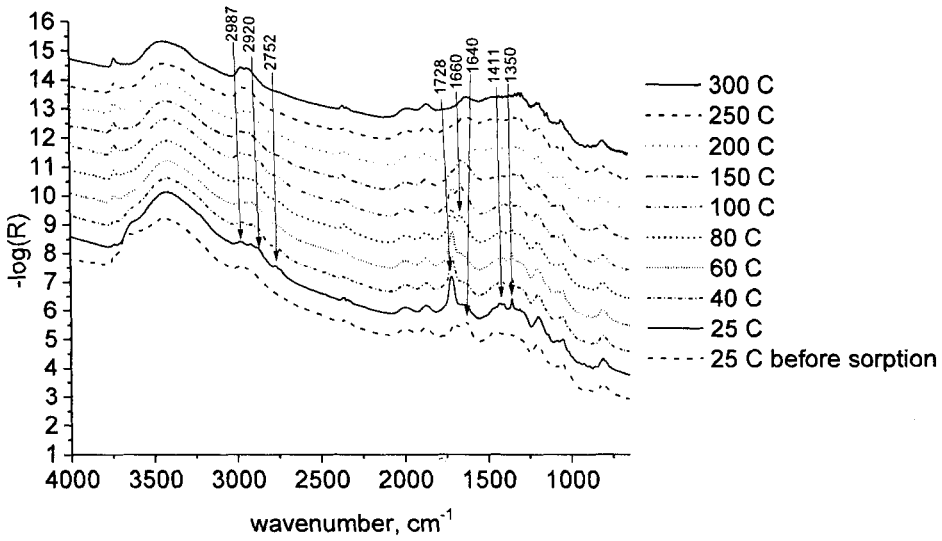
FIGS. 9A-9D are graphs (spectra) showing the results of sorption and catalytic tests of acetic aldehyde, without air access and in air, respectively, carried out by in situ FTIR with an adjustable slide for diffuse reflection (DRIFT) using the sonicated zeolite and the non-sonicated zeolite.
Figure 9B:
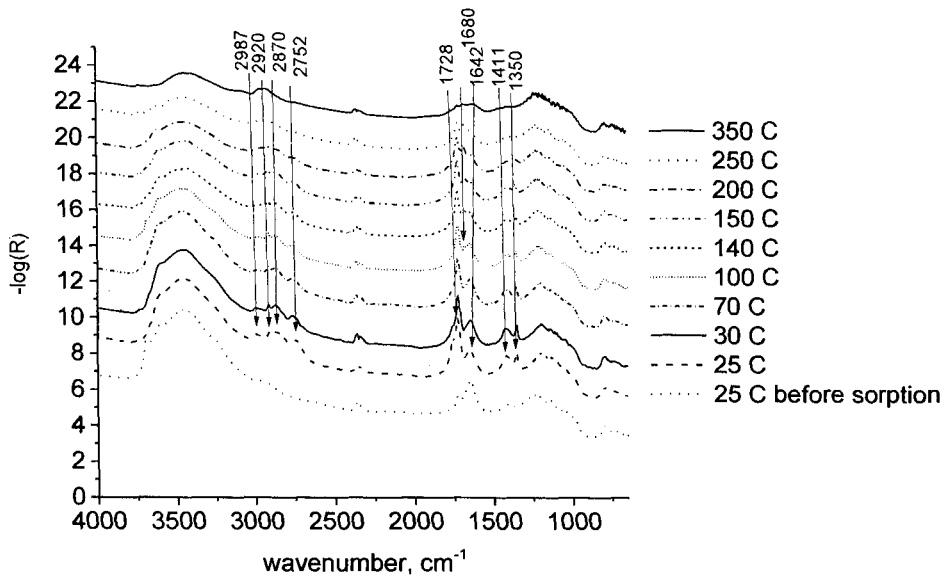
Figure 9C:
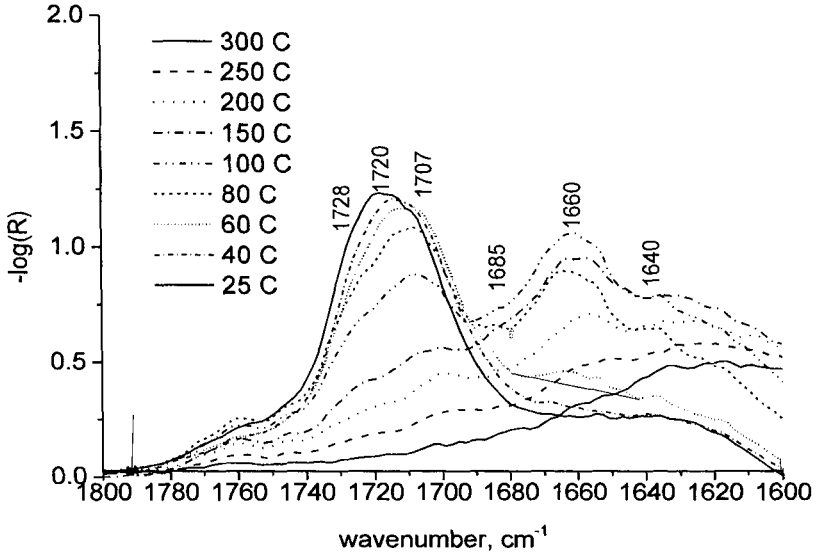
Figure 9D:
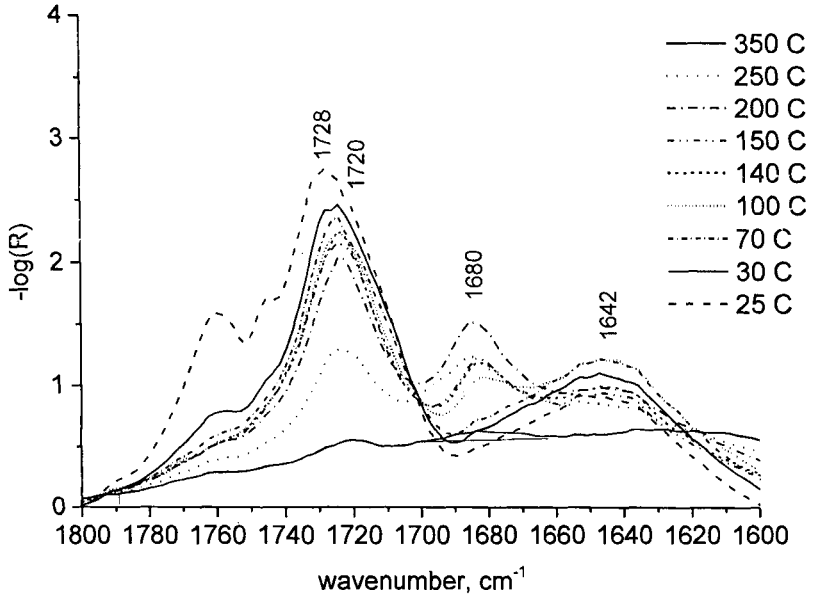
Figure 10A:
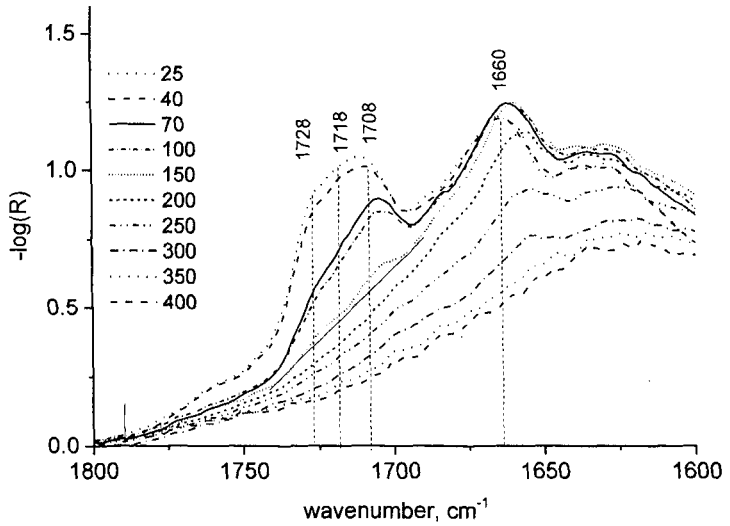
FIGS. 10A and 10B are graphs (spectra) showing the results of sorption and catalytic tests of acetic aldehyde, without air access and in air, respectively, carried out by in situ FTIR with an adjustable slide for diffuse reflection (DRIFT) using the sonicated zeolite and the non-sonicated zeolite.
Figure 10B:
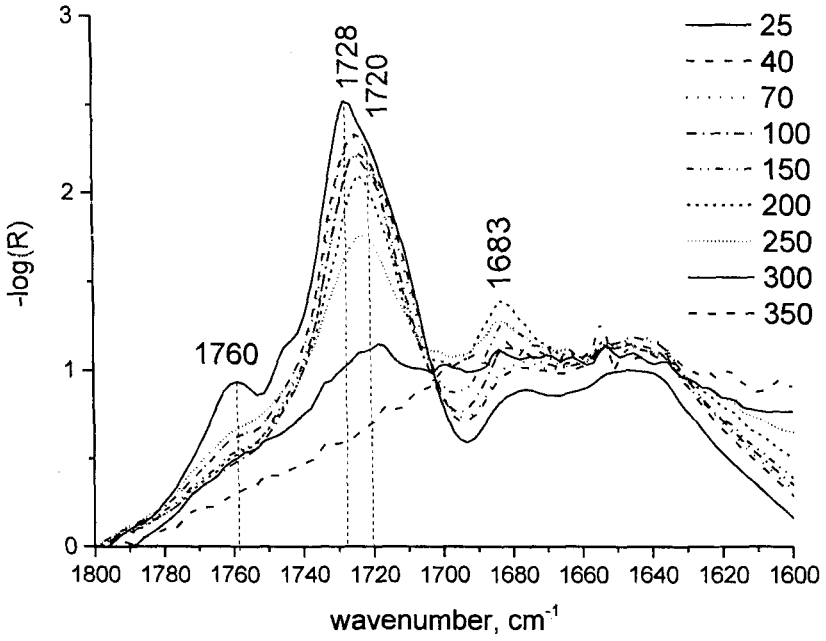
Figure 11A:
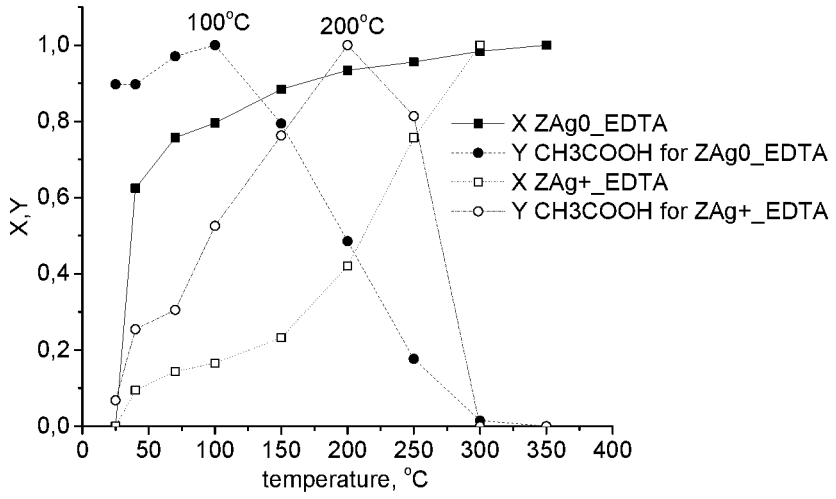
FIGS. 11A and 11B are graphs showing the quantitative results of spectroscopic studies by DRIFT presented in FIGS. 9A, 9B, 9C, 9D, 10A, and 10B, while the quantitative interpretation of bands from acetic aldehyde vibrations at 1780 $cm^{-1}$ is shown as the degree of conversion $X=(I_{25}-I_T)/I_{25}$, wherein I denotes the intensity of this band at a respective temperature (band intensity at 25° C. was assumed as the initial quantity of aldehyde); and those of acetic acid at 1680 $cm^{-1}$ shown as its degree of conversion Y calculated based on its band intensity at a respective temperature Y32 $I_T/I_{maxT}$ (maximum intensity observed for the given sample at the given temperature $I_{maxT}$ was used as the reference value).
Figure 11B:
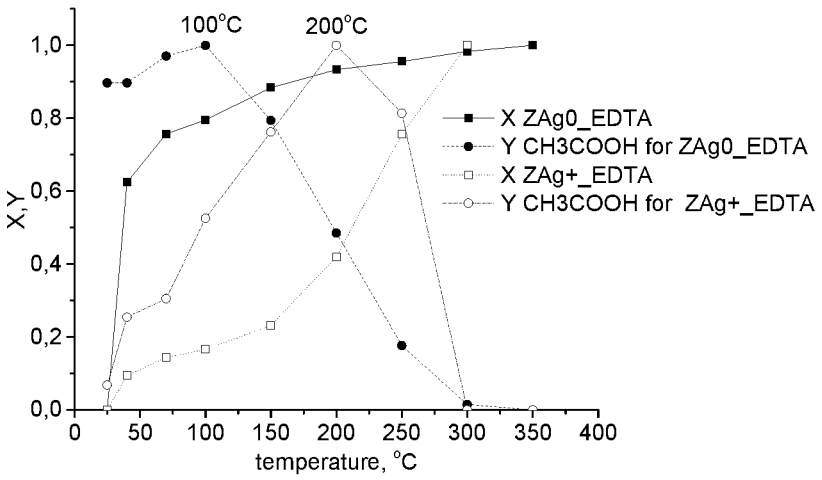
Figure 12:
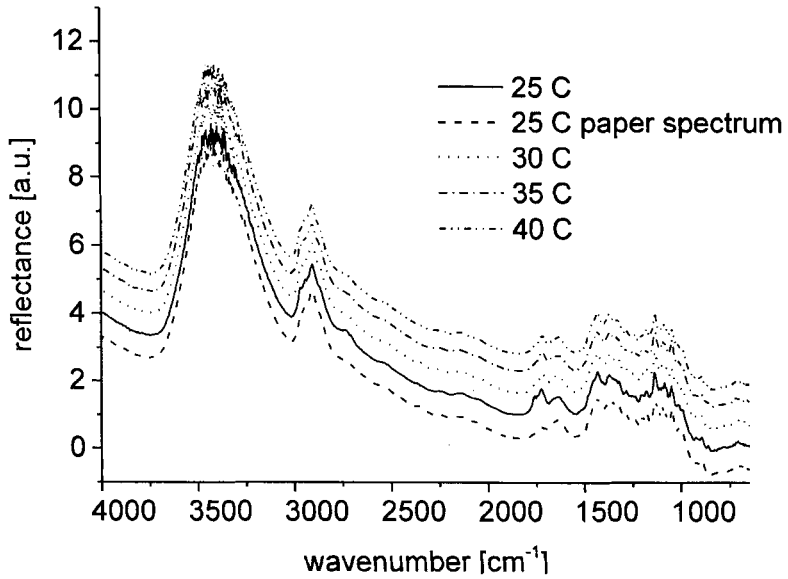
FIG. 12 is a graph (spectra) showing the results of acetic aldehyde sorption without air access for a paper sample with the sonicated zeolite [in situ FTIR (DRIFT)] spectra of acetic aldehyde sorption without air access for a sample of paper packed with the sonicated Y-type zeolite (PZAg0__EDTA).
Figure 13:
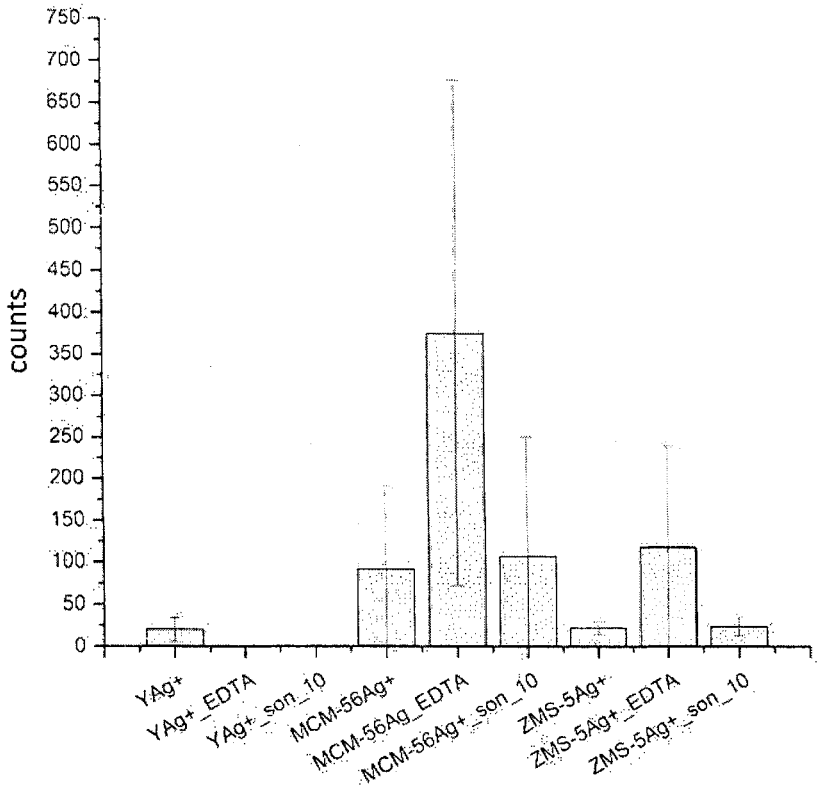
FIG. 13 is a bar graph showing a comparison of the microbiological activity of various zeolites exchanged with silver and sonicated (Biocidal activity against *E. coli* in the case of various zeolite materials (control test 9,000 counts)).
Figure 14:
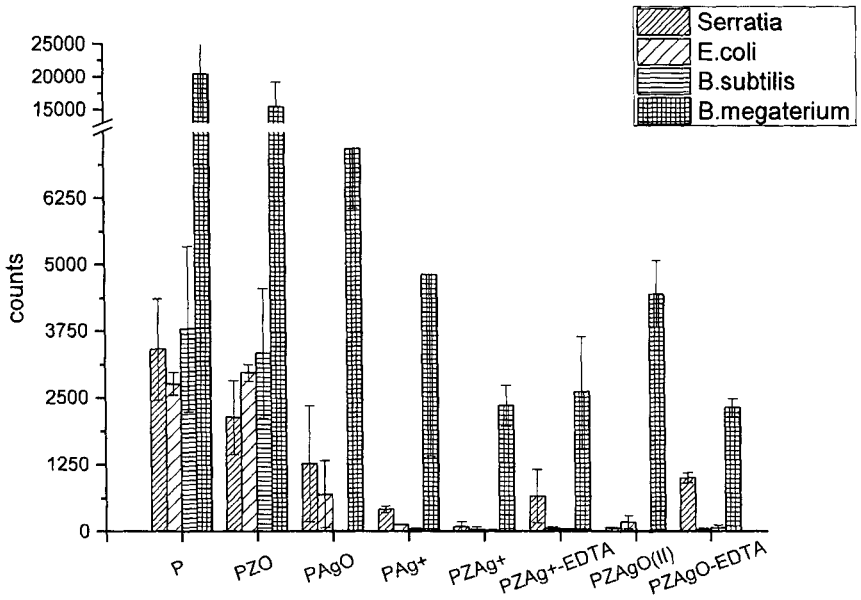
FIG. 14 is a bar graph showing the results of microbiological studies for various bacteria counts of samples in various stages of preparation and reference samples.
Figure 15:
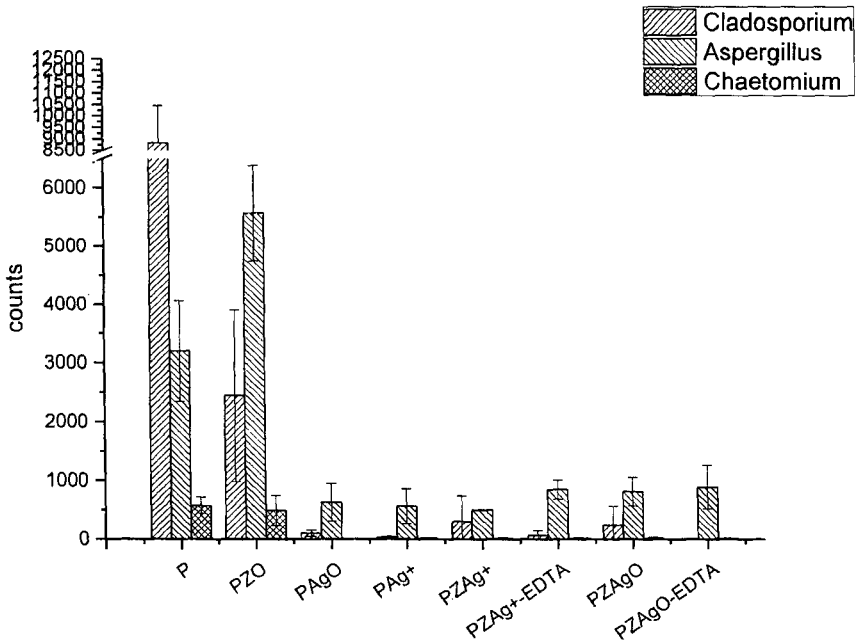
FIG. 15 is a bar graph showing the results of microbiological studies for various fungi counts of samples in various stages of preparation and reference samples.

The results of physicochemical and microbiological analyses of the invention are presented in FIGS. 1-15. FIG. 1 shows the quantitative characteristics of the exchange of silver cations in the zeolite in the form of an ion exchange isotherm created on the basis of X-ray fluorescence (XRF) analyses of the silver content in the zeolite; FIGS. 2-5 relate to studies on the influence of sonication on the zeolite being exchanged with silver; FIG. 2 shows the results of topographic analyses of the zeolite material subjected to sonication by atomic force microscopy (AFM) (topographic AFM maps (the first column) and crystallite edge distribution obtained by the no-contact method (the second column) of the Y-type zeolite samples subjected to sonication); FIG. 3 shows the results of diffractometric analyses of samples of the zeolites subjected to sonication; FIG. 4 shows the results of quantitative and qualitative analyses by in situ infrared spectroscopy (in situ FTIR) for sorption of CO on zeolite materials subjected to sonication and on reference materials (a) FTIR spectra of carbon monoxide adsorbed on $Ag^+$ions in the studied samples of the Y-type zeolite; b) A comparison of the conditions of zeolite activation); FIG. 5 shows the results of analyses of the silver content in the paper material packed with the sonicated zeolite; FIGS. 6-8 show the characteristics of the paper material packed with the zeolite; FIG. 6 shows the stability of the paper material determined by the pH measurements of samples in various stages of preparation and reference samples; FIG. 7 shows the stability of the paper material after ageing tests carried out according to the ASTM standard and expressed as the degree of polymerisation (DP) of cellulose; FIG. 8 shows the stability of the paper packed with the Y-type zeolite expressed as zero-span breaking strength; FIGS. 9A, 9B, 9C, 9D, 10A, and 10B show the results of sorption and catalytic tests of acetic aldehyde, without air access and in air, respectively, carried out by in situ FTIR with an adjustable slide for diffuse reflection (DRIFT) using the sonicated zeolite and the non-sonicated zeolite; FIGS. 9A-9D:

obtained at various temperatures under He flow for a sample of FIG. 9A the sonicated Y-type zeolite (ZAg0__EDTA), FIG. 9B the non-sonicated Y-type zeolite (ZAg+__EDTA). FIGS. 9C and 9D spectra are magnifications of FIGS. 9A and 9B spectra, respectively, in the range of carbonyl group vibrations; FIGS. 10A and 10B: In situ FTIR (DRIFT) spectra of conversion of the adsorbed acetic aldehyde obtained at various temperatures under the flow of air for a sample of FIG. 10A the sonicated Y-type zeolite (ZAg0__EDTA), FIG. 10B the non-sonicated Y-type zeolite (ZAg+__EDTA) shown in the range of carbonyl group vibrations; FIGS. 11A and 11B show the quantitative results of spectroscopic studies by DRIFT presented in FIGS. 9A, 9B, 9C, 9D, 10A, and 10B, while the quantitative interpretation of bands from acetic aldehyde vibrations at 1780 $cm^{-1}$ is shown as the degree of conversion $X=(I_{25}-I_T)/I_{25}$, wherein I denotes the intensity of this band at a respective temperature (band intensity at 25° C. was assumed as the initial quantity of aldehyde); and those of acetic acid at 1680 $cm^{-1}$ shown as its degree of conversion Y calculated based on its band intensity at a respective temperature $Y=I_T/I_{maxT}$ (maximum intensity observed for the given sample at the given temperature $I_{maxT}$ was used as the reference value). FIG. 11A for the experiment without air, FIG. 11B for the experiment under the flow of air (in this case, the results obtained in the experiment without air was used as $I_{25}$ considering the immediate reaction of the aldehyde); FIG. 12 shows the results of acetic aldehyde sorption without air access for a paper sample with the sonicated zeolite [in situ FTIR (DRIFT)] spectra of acetic aldehyde sorption without air access for a sample of paper packed with the sonicated Y-type zeolite (PZAg0__EDTA). FIG. 13 shows a comparison of the microbiological activity of various zeolites exchanged with silver and sonicated (Biocidal activity against *E. coli* in the case of various zeolite materials (control test 9,000 counts)); FIG. 14 shows the results of microbiological studies for bacteria; FIG. 15 shows the results of microbiological studies for fungi.

The invention is described in more detail in the following embodiment; however, the embodiment should not be considered the full scope of the invention.

EXAMPLE 1

Preparation of the Material According to the Invention Ion Exchange of the Zeolite A Y-type zeolite was the basic zeolite used for the studies, and the full optimisation of the ion exchange procedure presented below was carried out for it. Samples of ZSM-5 and MCM-56 reference zeolites were also used in the studies. The ion exchange procedure was as follows: 50 mg of the zeolite were introduced into 10 $cm^3$ of 0.1 M aqueous solution of $AgNO_3$, and the so-prepared suspensions were shaken at a rate of 300 rpm. The shaking was carried out without access of light. After the assumed sorption time, the suspension was centrifuged at a rate of 2.000 rpm. According to the optimisation carried out, the centrifugation was done 5 times. After washing, the precipitates were dried at a temperature of 120° C. Dried precipitates were conditioned for 24 h and weighed with an accuracy up to 0.1 mg. The samples were placed in a beaker, and 5 $cm^3$ of 65% solution of nitric acid was added. The suspension was heated to boiling and maintained at this temperature for 15 minutes. After cooling, the suspension was centrifuged (2,000 rpm), and the supernatant was quantitatively transferred to a graduated flask with a volume of 25 $cm^3$. The precipitate remaining on the bottom of the test tube was treated with deionised water and shaken until a suspension formed anew; this suspension was centrifuged. The supernatant was transferred to a graduated flask containing the solution after the first centrifugation. This procedure was repeated 5 times in total. The precipitate was dried and tested on the optionally remaining silver contents. The solution in the flask was made up to 25 $cm^3$ with deionised water. The so-prepared solution of silver (corresponding to the initial silver content in the zeolite) was analysed with XRF using the calibration curve method.

Determination of Silver in the Zeolite by X-ray Fluorescence Spectroscopy (XRF)

The measurements were carried out using an ED-XRF spectrometer (Quant'x-Thermo). Parameters of the measurement: t=60 s, air atmosphere, thin copper filter, large measurement cup. Kα emission line for silver was selected for the assay (integrated with the background cut-off in the range 21.46-22.60 keV). The determination of silver was carried out in $HNO_3$ solutions with the dissolved zeolite, and the results are shown in Table 1. The determination of silver content is burdened with an error of 5%, determined based on the reference to the blank test. The error is a consequence of the scatter of results—the correlation coefficient for fit of the curve developed based on the analyses of $AgNO_3$ standard solutions (see Table 1) amounts to $R^2=0.9819$. Incomplete leaching of silver from the zeolite by hot $HNO_3$ also contributes to the error. The silver content in the non-dissolved zeolite in the form of precipitate was also checked; however, the amount of silver in precipitates did not exceed 1% by wt. Thus, the assays of the silver content in the zeolite were based on analyses of the solubilised material.

The sorption isotherm determined with XRF indicated that half-exchange of the zeolite with silver ions under the described conditions is obtained after approx. 1 h (FIG. 1). The Y-type zeolite selected as a component of the material is maximally saturated with silver ions after 2 h of exchange with a 0.1 M $AgNO_3$ solution under the conditions described above, and the exchange isotherm for silver ions, similarly as in the case of other metals, approaches the maximum value asymptotically. Further exchange (for more than 2 h) does not yield any increase of the silver content in the zeolite, and further results are within the limits of the determination error. Measurements of the water content in the samples presented earlier indicated that this amount is practically constant (the scatter of results of 2.5%). Similar results were obtained for the reference zeolites of ZSM-5 and MCM-56 types. The ion exchange isotherms showed no differences in their shapes, and only slight differences in the ion exchange rate of the entire zeolite volume could be observed. A complete filling was obtained after only 1 h.

TABLE 1

Results of studies of the silver content in solutions after washing of the zeolite after the ion exchange using hot $HNO_3$. The penultimate position in the sample name (0.1) denotes the concentration of silver in the $AgNO_3$ solution used for the exchange, the last position - time of the ion exchange.

| Assay | Ion exchange time [h] | Count number | Silver content [mg Ag/g of the zeolite] |
|---|---|---|---|
| YAg_0.1_1 | 1 | 280,000 | 94.0 |
| YAg_0.1_2 | 2 | 429,500 | 263 |
| YAg_0.1_3 | 3 | 422,800 | 253 |
| YAg_0.1_20 | 20 | 396,006 | 246 |

TABLE 1-continued

Results of studies of the silver content in solutions after washing of the zeolite after the ion exchange using hot $HNO_3$. The penultimate position in the sample name (0.1) denotes the concentration of silver in the $AgNO_3$ solution used for the exchange, the last position - time of the ion exchange.

| Assay | Ion exchange time [h] | Count number | Silver content [mg Ag/g of the zeolite] |
|---|---|---|---|
| YAg_0.1_29 | 29 | 423,700 | 265 |
| YAg_0.1_39 | 39 | 374,800 | 225 |
| YAg_0.1_92 | 92 | 439,200 | 254 |
| Calibration curve data | | | |
| Concentration of the $AgNO_3$ solution [mol/dm$^3$] | — | — | — |
| 0.1 | — | 681,900 | — |
| 0.05 | — | 430,100 | — |
| 0.033 | — | 365,600 | — |
| 0.025 | | 298,100 | — |
| — | — | — | Determined concentration [mol/dm$^3$] |
| Blank test 0.05 | — | 424,900 | 0.0475 |

Preparation of a zeolite matrix

Based on the determined ion exchange isotherm, 1 hour was selected as the optimal ion exchange time. Three portions of 5.00 g each were weighed out. The first portion was placed in a beaker and treated with 100 cm$^3$ of 0.1 M aqueous solution of silver nitrate(V). The suspension was shaken for 1 hour at a rate of 300 rpm. The precipitate was filtered, and the recovered nitrate solution was used again for sorptions with portions two and three. The precipitates were rinsed with 500 cm$^3$ of distilled water in order to flush the excess silver nitrate. After drying of the precipitates at temperature of 60° C., they were combined and mixed, yielding a homogeneous sample. From the so-prepared base material, a representative sample was collected in order to carry out physico-chemical analyses (the results are presented later). The base material (zeolite exchanged with silver) was used as a filler of paper sheets in further preparations.

Modification of Structure and Composition of the Zeolite Matrix

The final prepared sample was washed with EDTA in order to remove the silver non-bound to the zeolite. Therefore, in the case of sonicated samples, it was carried out after sonication. However, for the sake of comparison of the sonicated samples with the non-sonicated reference samples, the washing procedure is described as in the first sequence. Optimisation of the washing procedure was developed for the non-sonicated samples and used further in the same way for the sonicated samples described in the invention.

Leaching of the Non-Bound Silver with an EDTA Salt Solution

Before application of the procedure of silver ions removal from the external surfaces of the zeolite crystallites, the influence of rinsing on the dealumination of the sample was tested. To this end, reference samples of the raw zeolite were rinsed with an aqueous solution of disodium salt of ethylenediaminetetraacetic acid (EDTA). The procedure consisted of three steps:

a) rinsing of the zeolite in a funnel (paper filter) with 150 ml of 0.01 M EDTA solution (room temperature),
b) flushing at boiling temperature with 150 ml of 0.01 M EDTA solution (maintaining time−1 hour),
c) rinsing with 150 ml of 0.1 M EDTA solution.

The flushing was carried out in a plain funnel using qualitative paper filters. Proper solutions were dosed so that the precipitate was immersed in the solution for the entire washing process. The precipitate was rinsed with a fresh portion of the complexone each time—the solutions were not recirculated. In the case of hot rinsing, the material being modified was placed in a beaker and treated with 0.01 M EDTA solution. The solution was mixed using a magnetic stirrer and maintained at boiling temperature for 1 hour.

Exclusion of Dealumination of the Zeolite

The filtrates were centrifuged (4,000 rpm, 4 min) and then characterised by atomic absorption spectrometry ASA (a Z 2000 atomic absorption spectrometer with Zeeman polarisation, HITACHI) in order to eliminate the possibility of dealumination of the zeolite during flushing. NMR analyses using a Bruker 400 MHz spectrometer with an attachment for solids was also performed. In Table 2, the results of the studies carried out for filtrates after treating the zeolites with $Na_2EDTA$ are shown. The results presented in Table 2 prove that treating the zeolites with cold 0.01 M EDTA solution does not cause leaching of aluminium from the structure. A zeolite heated in an aqueous EDTA solution for 1 hour was selected as a reference sample; in the case of this zeolite, dealumination occurred.

In this case, aluminium was detected in the filtrates by ASA. However, not detecting aluminium in the other solutions is not an unequivocal confirmation of a lack of dealumination in the zeolite lattice; therefore, analyses of the material were supplemented with the 27A1 MAS NMR method, used for determination of dealumination degree. To this end, dried precipitates after rinsing with an aqueous EDTA solution were tested on changes in the aluminium NMR signal. A standardisation of NMR spectra in relation to the surface area of the main signal for tetrahedral aluminium of the non-modified initial Y-type zeolite (A=1.0000) was carried out. Values for the measured samples are collected in Table 2. The obtained results indicate that the selected flushing method does not cause dealumination, proving the thesis that the zeolite does not change its crystal structure after chemical treatment (rinsing with 0.01 M EDTA). It should be noted that in the case of heating of the zeolite in the EDTA solution or application of a higher EDTA concentration, structural changes do occur. In the case of washing with 0.1 M EDTA, the loss amounted to 6%.

TABLE 2

The results of determination of aluminium in the filtrates after rinsing with EDTA.

| Assay | Treatment method | ASA method [c.u.] | NMR method percentage loss of aluminium from the lattice* |
|---|---|---|---|
| ZAg+_0.01_T25 | 150 cm$^3$ of cold 0.01M EDTA | 1 (not detected) | 0.05 |
| ZAg+_0.01 T100 | Heating for 1 hour in 0.01M EDTA | 33 | 3.80 |
| ZAg+_0.1 T25 | Rinsed with 150 cm$^3$ of 0.1M EDTA | 1 (not detected) | 6.10 |

*the results related to the dry precipitates of the zeolites standardised in relation to their mass, collected after the process described in the second column of the table. T25 and T100 assays relate to temperatures of 25 and 100° C., respectively.

Optimisation of Zeolite Rinsing

In order to optimise the time and multiplicity of the washing of the zeolite materials exchanged with silver using EDTA in order to complex the silver ions present on the external surfaces of the zeolite crystallites, an XRF analysis of the filtrates after rinsing (or solutions after centrifugation of suspensions) was performed.

TABLE 3

XRF quantitative analysis—transition line intensities for silver after consecutive washings with EDTA for a ZAg+ sample of the Y-type zeolite after ion exchange (shaking).

| Number of washings (solution volume V = number · 10 $cm^3$) | Analytical signal for silver [keV] |
|---|---|
| 1 | 1,710,009 |
| 2 | 224,776 |
| 3 | 13,700 |
| 4 | 3,134 |
| 5 | 2,215 |
| 6 | 2,731 |

The above results were obtained for a freshly prepared sample of the zeolite after ion exchange. As is shown by the analysis of the results collected in Table 3, a sufficient leaching of ions non-bound with the structure from the zeolite is obtained after five washings, when the signal of silver reaches a constant minimum level (studies on the influence of washing on the ions bound in the matrix were not carried out). The degree of elution of silver from the zeolite amounts to almost 100% when compared to the first washing, whereas the degree of elution between the $4^{th}$ and $5^{th}$ washing is lower than 0.1%. Thus, practically, there is no loss of the active material (with some approximation, as in the case of fresh materials, it is very hard to obtain a structure which would be completely resistant to washing with water). Taking this result into account, it was assumed that 5-fold rinsing with water is sufficient from the point of view of silver leaching. At the same time, this is consistent with the assumption for the optimisation of washing, which was to ensure a well-defined structure of materials with minimum amount of silver bound solely to the zeolite matrix.

Moreover, similar analyses were carried out for increasing volumes of the used EDTA solution. To this end, the same mass of the zeolite exchanged with silver ions was rinsed with consecutive portions of water (50 $cm^3$ each). From the so-prepared filtrate, 2 $cm^3$ of the solution was collected and analysed by XRF. As results from the data in Table 4, in this case, low values of the signal originating from silver were also obtained (the ratio of the last result to the first amounts to 0.13%).

TABLE 4

XRF quantitative analysis - rinsing of the sample of ZAg+ Y-type zeolite exchanged with silver ions using water.

| Total volume of water portions [$cm^3$] | Analytical signal for silver* [keV] |
|---|---|
| 0 | 1,047,293 |
| 50 | 51,722 |
| 100 | 3,019 |
| 150 | 1,393 |

*signal standardised in relation to the mass of the sample and the volume of the examined filtrate.

Application of an EDTA solution is, as proven, a good method for minimisation of the amount of silver in the samples to the level of silver bound with the zeolite matrix. The premise is that it prevents migration of silver to the environment, particularly to food, which is often characterised by high humidity. It is also noteworthy that after washing with 40 $cm^3$ of EDTA, a stable leaching level is obtained (Table 3). However, the degree of elution does not decrease as in the case of water. Obviously, after complexing all ions weakly bound with the structure of the zeolite, the EDTA solution may have access to bound silver ions exchanged in the zeolite.

In the next optimisation stage, the stability of final zeolites exchanged with silver ions in aqueous solutions was investigated (this time, after prior drying of the samples—the starting material). The degrees of elution of silver ions by water and EDTA were compared. The results are gathered in Table 5.

The results presented in Table 5 indicate that the zeolite packing loses negligible amounts of silver in an aqueous medium. Besides this, the silver content in post-extraction solutions after washing with 50 $cm^3$ of water falls below the limit of detection. The so-washed sample was then washed with an EDTA solution—consecutive portions of 10 $cm^3$ each (coloured part of Table 5). The efficiency of elution of silver ions with an EDTA solution is significantly higher than that of water (150-200 times) and increases together with an increase in the solution volume. When water was not able to leach the silver ions further, a high signal of silver was obtained for the EDTA solution.

TABLE 5

Rinsing of the same sample of the Y-type zeolite exchanged with silver ions (ZAg+) using water and then EDTA. In the results presented in Tables 3 and 4, the same sample divided into parts was used.

| | Analytical XRF signal for silver [—] |
|---|---|
| Total volume of water in consecutive washing with 10 $cm^3$ portions [$cm^3$] | |
| 10 | 2,129 |
| 20 | 737 |
| 30 | 561 |
| 40 | 399 |
| 50 | <LOD |
| Total volume of EDTA in consecutive washing with 10 $cm^3$ portions | |
| 10 EDTA | 150,045 |
| 20 EDTA | 55,039 |
| 30 EDTA | 23,001 |
| 40 EDTA | 22,100 |

Moreover, the optimisation of concentration and amount of the EDTA solution used for rinsing of samples of the zeolites substituted with $4^+$ cations was carried out based on analyses of the surface by XPS for $Ag^+$ band with a bond energy of 432 eV in the spectrum. In Table 6, the results of quantitative analysis of samples of the modified zeolite are shown (the symbols denote, respectively: ZAg+—non-washed zeolite substituted with silver ions, ZAg+_$H_2O$—zeolite exchanged with silver ions washed with deionised water, ZAg+_0.01M_EDTA_150—zeolite exchanged with silver ions washed with 150 $cm^3$ of 0.01 M EDTA and water, ZAg+_0.01M_EDTA_150—zeolite exchanged with silver ions washed with 150 $cm^3$ of 0.1 M EDTA and water, ZAg+_0.01M_EDTA_300—zeolite exchanged with silver ions washed with 300 $cm^3$ of 0.01 M EDTA and water.

The results show that increasing the EDTA concentration from 0.01 M to 0.1 M for ZAg+_0.01M_EDTA_150 and _ZAg+_0.1M_EDTA_150 samples, respectively, causes further leaching of silver from the surface of the zeolite crystallites. In order to minimise the amount of silver, a more concentrated EDTA solution was used for further washing tests. In turn, an increase in the amount of the solution used for rinsing from 150 to 300 $cm^3$ for ZAg+_0.1M_EDTA_150 and ZAg+_0.1M_EDTA_300 samples, respectively, does not cause further leaching of silver, and the differences between the determined amounts of $Ag^+$ are within the limits of measurement error. The results of the XPS analysis are consistent with those obtained by XRF. After leaching ions weakly bound with the structure (approx. 40-50 $cm^3$), EDTA is still able to leach silver from the structure; however, the degree of leaching remain at a low constant level.

TABLE 6

Quantitative results of XPS for silver on the surface of the zeolite crystallites after rinsing with EDTA.

| Sample | EDTA concentration [mol/dm³] | Rinsing [cm³] 1 | Rinsing [cm³] 2 | Signal for silver after normalisation [a.u.] |
|---|---|---|---|---|
| ZAg+ | — | — | — | 1.05 |
| $ZAg^+$_$H_2O$ | — | 150 $H_2O$ | 150 $H_2O$ | 1.19 |
| $ZAg^+$_0.01M_EDTA_150 | 0.01 | 150 EDTA | 150 $H_2O$ | 1.25 |
| $ZAg^+$_0.1M_EDTA_150 | 0.1 | 150 EDTA | 150 $H_2O$ | 0.29 |
| $ZAg^+$_0.1M_EDTA_300 | 0.1 | 300 EDTA | 150 $H_2O$ | 0.31 |

The performed optimisation of flushing of samples of the starting materials showed that the applied preparation method allowed for the obtaining of stable materials with a minimum amount of silver strongly bound with the zeolite matrix, which was used for further modification of the material.

Sonication

Sonicated samples of the zeolites exchanged with silver cations were prepared as reference samples containing nanoparticles of metallic silver dispersed in the zeolite matrix. These samples were necessary for a comparison of the biocidal properties of silver cations and those of reduced silver. Below, a method for the sonication of samples is presented.

Procedure of Sonication in Solutions

Synthesis of metallic nanoparticles as reference samples was carried out in an aqueous $AgNO_3$ solution (0.1 M). The first step consisted in checking whether nanoparticles form in the process, what are their sizes and if they are stable. An ultrasound generator with a power of 20,000 kHz was used for synthesis. In the first step, a possibility for synthesis of silver nanoparticles in an $AgNO_3$ solution without additives was examined. In subsequent steps, the procedure was modified in such a way that increasing amounts of ethanol (max. 5 $cm^3$) were added to the solution. The last step consisted in the application of a blowthrough of an inert gas (argon) for 60 minutes before turning on the ultrasound, as well as a reducing mixture ($H_2$/He—5/95%$_{vol.}$) during the sonication process.

Procedure of Sonication in a Suspension of the Zeolite

Silver nanoparticles were also synthesised in the zeolite matrix. To this end, 1.00 g weighouts of the Y zeolite were prepared and placed in a beaker. The zeolite was treated with 150 $cm^3$ of distilled water and flushed with argon (15 minutes). The sonication process was carried out using an ultrasound generator (QSonica S-4000, ½" diameter head, $P_{short\text{-}term}$=90 W, $E_{total}$=approx. 97,000 J) (after 30 min) for a time consistent with the data in Table 18. Conditions of sonication—average power 90 W, temperature of the solution—below 60° C. In the final phase, a blowthrough of the zeolite suspension with the reducing mixture for 1 hour and during sonication was applied.

TABLE 7

Time of sonication of the zeolite samples.

| No. | Assay* | Time of sonication [min] |
|---|---|---|
| 1 | Z | 0 |
| 2 | Z_son_10 | 10 |
| 3 | Z_son_20 | 20 |
| 4 | Z_son_30 | 30 |

Influence of Sonication on the Structure of the Zeolites

Studies on the influence of sonication on dispersion of the zeolite were carried out using atomic force microscopy (AFM, Park Systems, model XE100). The images shown in FIG. 2 indicate that refinement of samples increases when the time of sonication increases. In the case of the sample sonicated for 30 minutes, one may notice a dramatic decrease of graining. While estimating the sizes of grains, one may observe that for the non-sonicated sample, the grains have an average size of approx. 3 μm, and for the Z_son_10 sample, the sizes are approx. ten times lower, respectively. In the case of the sample sonicated for the longest time, Z_son_30, their renewed growth is observed; however, analysis of the shape of their edges indicates that larger grains are composed of combined minute ones. In the case of a longer sonication time, the obtained samples were hard to filter, as they did not deposit on the paper filter and penetrated into the filtrate (thus, their centrifugation was necessary). This has a significant impact on the handling of this material—difficulties with retention of the active material in the cellulose matrix. Nevertheless, because of a lack of changes in the character of the material, a 30-minute sonication time was chosen when considering a change of the procedure of filtration of the material for this sample.

Studies on the influence of sonication on the zeolite structure by X-ray diffraction (XRD) were carried out for starting (not listed) samples of the Y-type zeolite subjected to sonication (Table 7). There were no differences found in the diffractograms (FIG. 3). Characteristic reflections connected with the structure of the Y-type zeolite may be identified in the, diffractograms—among others, 7.42, 10.05, 11.93, 20.40, 37.73. Based on the investigations carried out, one may ascertain that treating samples of the zeolites with ultrasound does not affect their phase composition.

Form and Amount of Silver in the Zeolite

The goal of this part of the research consisted in determination of the composition of the zeolite and the form of silver occurring in it. The studies also enabled determination of the sorptive capacity of the zeolite for the CO molecule. A technique of in situ infrared spectroscopy (in situ FTIR) was used in the studies, with a probe molecule for $Ag^+$ cations (the band from vibrations of CO adsorbed on $Ag^+$ occurs at 2,170 $cm^{-1}$). The measurements were carried out using two methods:

Sorption of carbon monoxide at room temperature was carried out in order to define the quantitative ratio between the silver atoms in the first and zero oxidation state. The results are presented in FIG. 4. The analyses show that both sonication and rinsing of the materials during preparation with an aqueous $Na_2EDTA$ solution affects this ratio significantly (decrease in the $Ag^+$ content). Rinsing with an EDTA solution aimed to elute the silver ions located outside the lattice (non-exchanged with the zeolite), being reflected in a lower amount of adsorbed CO in relation to the reference sample (compare $ZAg^+$ and $ZAg^+$_EDTA). According to the ion exchange carried out (FIG. 1), the ion exchange time guarantees a half-exchange of the sodium ions by the silver ions. Thus, the determined exchange time and type of the zeolite (here Si/Al=2.5) determinate the total amount of silver ions per unit cell of the zeolite equal to 27. The analysis carried out shows that in the case of the zeolite exchanged with silver cations, this number per unit cell is almost 2 times lower and amounts to 15.5 ions/cell. Therefore, a part of the silver ions is reduced (or located in places unavailable for carbon monoxide).

Activation of the zeolite samples using conditioning in a vacuum was carried out at two temperatures—room temperature, as well as at 80° C. and 450° C. Measurements at a temperature of 80° C. were carried out in order to check whether a removal of water from the zeolite by evaporation is possible, while preserving the intensity of the band originating from carbon monoxide being adsorbed, enabling an analysis of the samples. For the Y-type zeolite, this band is located at 2,175 $cm^{-1}$ and is attributed to an $Ag^+(CO)$ monocarbonyl group. As is shown in FIG. 4 (right spectra), sufficient band intensity was obtained only in the case of samples activated in a vacuum at room temperature. In the case of temperature activation, this band practically fades both for the temperature of 80° C. and 450° C. Thus, the band recorded at 2,175 $cm^{-1}$ after activation with a vacuum at room temperature was chosen as a marker of the silver(I) content in the zeolites. Application of a vacuum made desorption of water from the zeolite from the silver coordination sphere possible, enabling a quantitative interpretation of the results of CO sorption on $Ag^+$ centres, without the introduction of determination errors.

The results obtained after activation of the zeolite samples exchanged with silver at room temperature indicate that there is a high probability of occurrence of silver(I) in hexagonal prisms, because of the number of —OH groups lower than in unexchanged zeolites. Activation at an elevated temperature (80° C.) allows for ascertaining that migration and reduction of silver occur in the zeolite, being in turn connected with formation of —OH groups, which now have to balance the negative charge of the lattice. Metallic silver particles cannot perform this function.

The degree of reduction of silver is higher in the case of the sample sonicated for a shorter time. In the case of the sample sonicated for 30 min and additionally washed with EDTA (ZAg+_son_30_EDTA), leaching of silver cations is observed, with an effect comparable to the non-sonicated sample (ZAg+_EDTA).

TABLE 8

Number of silver ions per unit cell in the zeolite.

| Sample | Number of ions $Ag^+$/unit cell | Fraction of $Ag^+$ in the sample | Atomic ratio $Ag^+/Ag^0$ |
|---|---|---|---|
| ZAg+ | 15.5 | 1 | 1:0 |
| ZAg+_EDTA | 6.4 | 1 | 1:0 |
| ZAg0_son_10 | 8.5 | 0.6 | 3:2 |
| ZAg0_son_10_EDTA | 3.0 | 0.5 | 1:1 |
| ZAg0_son_30 | 14.0 | 0.9 | 9:1 |
| ZAg0_son_30_EDTA | 5.0 | 0.8 | 4:1 |

The presented results of the studies are complementary with XPS and XRF studies. Rinsing with an EDTA solution causes a decrease in the amount of silver ions (approx. 3-fold). In turn, the sonication process leads to a reduction of silver ions (formation of —OH groups) only, however, when a short sonication time is used (10 min). Longer sonication results in repeated oxidation of silver.

Using the results presented in Table 8, the degree of reduction of silver in a given sample (rinsed or non-rinsed series) may also be calculated. While calculating, it is assumed that a maximum amount of silver cations for the non-rinsed series is present in the ZAg+ sample, and for the series rinsed with EDTA—in ZAg+_EDTA. Therefore, the fraction of the amount of silver cations in the sample amounts to 1 for reference samples. One should note that by proper selection of sonication time and application of the washing procedure, one may select the $Ag^+$:$Ag^0$ ratio in the obtained material. As for the operation of the material as a catalyst, the ZAg0_son_10 _EDTA sample was selected as an optimal material. This sample has a balance of oxidised and reduced silver, being important from the point of view of catalytic activity. This sample will be hereinafter referred to as ZAg0_EDTA.

EXAMPLE 2

Development of a Method for Shaping Paper Sheets Packed with the Zeolite

Samples of paper sheets were prepared by disintegration of 4.00 g of Whatman filter paper in 400 $cm^3$ of distilled water using a dispersing instrument (IKA T18 Ultra-Turrax). Depending on the type of the prepared sample, the properly prepared active material in the form of the zeolites (Table 9) was added to this paper pulp.

TABLE 9

A method for preparation of model samples of the packaging material.

| Assay* | Active material | Method for preparation of active material - addition to the paper pulp |
|---|---|---|
| P | none | not applicable |
| PAg+ | $Ag^+$ | 0.51 g of silver nitrate(V), corresponding to 0.003 mole of Ag in the material volume |
| PZ0 | Y | 1.77 g of the Y-type zeolite in the paper pulp |
| PAg0 | $Ag^0$ | 0.51 g of silver nitrate(V), sonicated in a suspension together with the paper pulp for 10 minutes (A = 100%) |
| PZAg+ | AgY | 1.77 g of the Y-type zeolite exchanged with $Ag^+$. |
| PZAg0 | AgY and $Ag^+$ | 1.77 g of the Y-type zeolite exchanged with $Ag^+$, sonicated for 10 minutes (A = 100%) |

TABLE 9-continued

A method for preparation of model samples of the packaging material.

| Assay* | Active material | Method for preparation of active material - addition to the paper pulp |
|---|---|---|
| PZAg+_EDTA | Y-type zeolite exchanged with silver ions - rinsed with EDTA | 1.77 g of the Y-type zeolite exchanged with $Ag^+$, rinsed with 300 $cm^3$ of 0.1M EDTA solution and 150 $cm^3$ of distilled water |
| PZAg0_EDTA | Y-type zeolite exchanged with silver ions, rinsed with EDTA and subjected to sonication | 1.77 g of the Y-type zeolite exchanged with $Ag^+$, rinsed with 300 $cm^3$ of 0.1M EDTA solution and 150 $cm^3$ of distilled water and sonicated for 10 minutes (A = 100%) |

The paper pulp was prepared according to the description shown in Table 9. The pulp was formed into paper sheets using a Büchner funnel or a vacuum plate. A hydrophobic cloth was used as a supporting element for the paper pulp being filtered. Drying of the sheets was carried out on a glass pane at room atmosphere. From the dried sheets, samples in the form of discs with a diameter of 6 mm were cut out. The samples were protected by placing them in paper envelopes. Disinfection of the samples was carried out in the stage of microbiological studies.

Apart from the ion exchange of silver of the zeolites selected as the active material added to the paper sheets, it was necessary to develop proper procedures for preparation of sheets packed with the zeolite.

Original Procedure

In the original procedure for preparation of sheets in an aqueous medium, the active material (here the Y-type zeolite) was mixed with paper pulp dispersed in deionised water. In the beginning of the procedure's optimisation, a Büchner funnel was used to form the paper discs. Such a mode of operation required that the paper mass (with a volume of 400 $cm^3$) was filtered off on an area with a diameter of approx. 25 mm. Therefore, it was necessary to pour the paper pulp slowly through a tube specially adapted to this purpose. After drying, the discs varied in their appearance depending on the side (bottom or top on the filtrating cloth). For the sake of these differences, the discs were tested for homogeneity of distribution of the active material in the volume of the sheet. The paper discs were examined by XRF spectroscopy, on each side, determining the silver content. The results obtained for all tested sheets proved that there are significant differences (up to 10%) in the amount of silver, depending on the side of the sample. Such a difference might affect the analysis of microbiological activity, because its results would depend on the arrangement of the paper disc on the nutrient medium. Most probably, the observed differences in the distribution of the zeolite material resulted from separation of the material components as a result of filtration. Moreover, it is noteworthy that in the case of thick paper samples, with the thickness of the order of 3 mm, a mass attenuated coefficient of X-rays penetrating the sample begins to be of significance, which is connected with attenuation of the XRF signal. In such a case, only the layer of the material reached by X-radiation is analysed. Considering the fact that during filtering and forming of the sheets, a segregation of silver occurs (the zeolite sediments faster than the paper pulp); the silver content may be measured only in the paper layer enriched with silver and not in the entire sample. Thus, the method for preparation of the paper sheets had to be changed so as to guarantee uniform distribution of the active material.

Modified Procedure

In the modified procedure, a vacuum plate was used, enabling the forming of paper sheets with a size of approx. 15-20 cm. Filtration time on such a large surface, with the same suction power, was reduced incomparably. The sheets were devoid of water practically at the instant the paper pulp landed on the filtration cloth. The sheets were then removed from the filtration cloth and placed on a glass pane (flat surface) for drying. From the so-prepared sheets, samples for tests were collected (now with a diameter of approx. 6 mm). In order to determine whether there were any changes in the silver content depending on the side of the sheet, an XRF analysis was carried out as in the previous case. The obtained results proved that there is no difference in the amount of silver depending on the side of the sample (differences below standard deviation of silver content measuremets). The paper sheets prepared using the new method were treated as model samples in physico-chemical studies and determination of the sorptive, catalytic and microbiological activity.

Loss of the Active Material during Forming of the Sheets

In spite of the optimisation of the procedure for preparation of the paper sheets aimed to ensure their homogeneity, it was necessary to determine the degree of loss of the active material. This indicated that the exchanged zeolite was placed in an aqueous medium in which leaching of silver from the zeolite structure could occur. Moreover, a concern arose that a part of the zeolite (particularly in the case of sonicated samples—comp. the influence of sonication on the zeolite structure described in a further part of the document) could be leached during filtering. Such a possibility occurs particularly in the first moments of filtering, when the zeolite had direct contact with the filtration paper and was able to penetrate through it. In order to verify this, the system for shaping of the sheets was equipped with a washer collecting the filtrate. The filtrate was then analysed with XRF in order to detect silver ions. The obtained results indicate that forming of the sheets was connected with a loss of silver. The analysis was based on the K$\alpha$ line for silver. However, it should be emphasised that it was a semi-quantitative analysis. For the sake of the size of the system and the problem with quantitative collection of the entire filtrate, quantitative analysis made no sense. In connection with the detection of silver in the filtrates and the problem with quantitative measurements of the silver content, the final paper sheets were examined for silver content separately. The determination procedure was identical as in the case of the zeolites, but a sample of the paper was solubilised instead of the zeolite.

Determination of the Silver Concentration in the Paper Sheets

During the optimisation of the silver content in the final material, quantitative analysis was synchronised with the microbiological analysis in order to define the minimum silver content in the paper which would yield a satisfying biocidal activity. In Table 10, microbiological activity against the tested model organisms is shown.

TABLE 10

Microbiological activity of the paper materials with various silver contents against selected test organisms.

| Silver content mg Ag/g of the paper | Bacteria | Fungi |
|---|---|---|
| 87 | + | + |
| 71 | + | + |
| 46 | + | + |
| 10 | + | + |
| 1 | + | +/− |

The silver content was determined according to the following procedure:

0.02 g of the paper was weighed out, approx. 7.5 ml of 65% nitric(V) acid was added to it, and the mixture was brought to boiling. The suspension was maintained at boiling temperature for 15 minutes while stirring. The suspension was transferred quantitatively to a test tube and centrifuged at a rate of 4,000 rpm. The supernatant was transferred quantitatively to a graduated flask with a volume of 25 ml. Distilled water was added to the precipitate in the test tube; the content was mixed, obtaining a suspension, and then centrifuged again. The procedure was repeated five times. The solution in the flask (after the procedure was finished) was made up to the mark. These solutions constituted the basis for the determination of silver with XRF.

The concentration of silver in the prepared samples was determined with XRF from the calibration curve. The results are shown in FIG. 5, and the percentage composition—in Table 11.

TABLE 11

Percentage of silver in the final material and in the reference samples.

| Sample | Silver content mg Ag/g of the paper | % of silver content in the paper |
|---|---|---|
| PAg+ | 2.69 | 0.3 |
| PZAg+ | 14.9 | 1.5 |
| PZAg+_EDTA | 10.9 | 1.1 |
| PZAg0 | 31.1 | 3.1 |
| PZAg0_EDTA | 5.9 | 0.6 |

In the final material subjected to sonication and then washing with EDTA based on the developed procedure, the silver content is below 1% by wt. and amounts to 0.6% by wt.

EXAMPLE 3

Properties of the Obtained Paper Material

Stability of the Obtained Paper Material

Acidity of the Paper

The parameters defining the stability of the paper include its acidity determined by the pH measurements. Measurements of the pH of the paper samples were carried out using a flat plate electrode (Flatrode Hamilton, 809 Titrando—Metrohm). Samples were cut out from the prepared paper sheets, and a drop of water was placed on each of them. A flat plate electrode was then applied to the sample, and the pH was measured until a stable value was obtained (however, for not less than 120 s). The measured pH values are presented in FIG. 5.

Another parameter defining the stability of the paper may consist in its degree after ageing tests. Conditioning of the samples was carried out according to the D685 ASTM standard at 23° C. and RH=50%. A procedure described in the D6819-02(2007) ASTM standard was used for the ageing tests. Ageing was carried out in a climatic chamber at 90° C. and a relative humidity of 59%. The ageing time of the samples amounted to 12 days. Both the paper made of pure cellulose and the paper with the zeolite were aged.

Degree of Polymerisation of Cellulose

The weight-averaged degree of polymerisation ($DP_w$) of cellulose in the form of cellulose triphenylcarbamate (CTC) was determined. Analysis of molecular mass distributions was carried out in tetrahydrofurane, with double detection: by multiple angle laser light scattering (MALLS, Waters) and refractive index (RI). Both detectors worked at a light wavelength of 658 nm. In the measurements, a value of the specific increment of the refractive index equal to 0.162 $cm^3/g$ was used, determined experimentally on the chromatographic system used later for measurements of molecular mass distributions of the material.

The cellulose material with zeolite was subjected to a standard procedure of the preparation of samples. The zeolite was separated from the CTC solution by filtration of the solution through a Teflon syringe filter with pore diameter of 0.45 μm. The filtered solution was subjected to further SEC analysis.

The paper with silver ions/nanoparticles and with silver ions/nanoparticles and the zeolite was washed before derivatisation in order to remove the silver ions/nanoparticles to avoid contamination of the chromatographic column. Samples of the paper containing $Ag^0$, $Ag^+$ and zeolite were defibered in a beaker in 50 $cm^3$ of water (the process was aided by an ultrasound bath).

TABLE 11

Weight polymerisation degrees $DP_w$ of model paper samples (SD—standard deviation), ageing - 12 days.

| Assay | Type of the material | $DP_w$ | SD |
|---|---|---|---|
| P | Non-aged cellulose | 1,228 | 8 |
| P_S12 | Cellulose aged for 12 days | 918 | 95 |
| PZ0 | Cellulose with the zeolite - non-aged | 1,238 | 82 |
| PZ0_S12 | Cellulose with the Y-type zeolite - aged | 1,285 | 44 |
| PAg+ | Cellulose with silver ions - non-aged | 1,288 | 7 |
| PAg+_S12 | Cellulose with silver ions - aged | 115 | 3 |
| PZAg+ | Cellulose with the AgY zeolite - non-aged | 1,077 | 38 |
| PZAg+_S12 | Cellulose with the AgY zeolite - aged | 423 | 14 |
| PAg0 | Cellulose with $Ag^0$ sonicated for 10 min - non-aged | 1,357 | 61 |
| PAg0_S12 | Cellulose with $Ag^0$ sonicated for 10 min - aged | 190 | 5 |
| PZAg+_EDTA | Cellulose with AgY, rinsed with EDTA - non-aged | 1,362 | 33 |
| PZAg+_EDTA_S12 | Cellulose with AgY, rinsed with EDTA - aged | 591 | 13 |

TABLE 11-continued

Weight polymerisation degrees $DP_w$ of model paper samples (SD—standard deviation), ageing - 12 days.

| Assay | Type of the material | $DP_w$ | SD |
|---|---|---|---|
| PZAg0 | Cellulose with AgY and $Ag^0$ sonicated for 10 min - non-aged | 1,341 | 17 |
| PZAg0_S12 | Cellulose with AgY and $Ag^0$ sonicated for 10 min -aged | 287 | 6 |
| PZAg0_EDTA | Cellulose with z AgY and $Ag^0$ sonicated for 10 min,rinsed with EDTA - non-aged | 1,259 | 28 |
| PZAg0_EDTA_S12 | Cellulose with AgY and $Ag^0$ sonicated for 10 min, rinsed with EDTA - aged | 514 | 37 |

The weight-averaged degree of polymerisation was calculated based on the molecular mass distributions of the studied samples, obtained by SEC using a multiple angle laser light scattering (MALLS) detector.

When comparing the samples before ageing in relation to $DP_w$, one may ascertain that in spite of some decrease in the degree of polymerisation, resulting from the addition of a filler containing silver ions, the PZAg+_EDTA sample exhibits the lowest decrease in polymerisation in relation to the non-aged sample, significantly lower than the sonicated PZAg0 sample. Moreover, a slight increase in $DP_w$ was observed for the non-aged PZAg+_EDTA in comparison to the initial sample of the paper.

In order to improve the structural parameters of the paper, the procedure of development of the final material was extended with an additional step of washing the paper packed with the zeolite and sonicated (PZAg0) with an EDTA salt solution, in the manner described in previous sections. Thus, the formed paper material (PZAg0_EDTA sample) had structural properties close to those of the $PZAg^+$_EDTA material.

A correlation of $DP_w$ and pH results may be noticed. The sheet exhibited a more basic reaction (PZ0) than the reference sample (P) only in the case of the paper packed with the zeolite. Therefore, it may be concluded that the increase in the degree of polymerisation of samples of the paper packed with the zeolite, sonicated and then rinsed with EDTA is connected with the decrease in acidity of the paper.

Mechanical Properties

As is shown in FIG. 8, an addition of the zeolite to the paper leads to an increase in its tenacity—the zero-span breaking strength is higher for the paper sample with the zeolite, sonicated and rinsed with EDTA than for the reference paper. It may also be noticed that rinsing the paper packed with the zeolite exchanged with silver with an EDTA solution both before and after sonication improves the mechanical properties of the paper immensely. However, based on the obtained results, one cannot definitely conclude that the addition of active material to the paper impacts its material strength (in terms of breaking strength). The high measurement error visible in the above chart results from the measurement method itself and from the manner in which the measurements were carried out in.

Sorptive and Catalytic Properties

A part of the studies on sorption using carbon monoxide was presented in the previous section. In order to define the sorption and catalytic potential of the materials, acetic aldehyde was used for the studies as a representation of volatile organic compounds and, simultaneously, a possible product of degradation of various products (food, paper), as well as for the sake of its undesirable influence on human health. Samples of the sonicated zeolite ZAg0_ EDTA (sample sonicated for 10 min) and the non-sonicated zeolite $ZAg^+$_EDTA were used for the comparison.

The experiments were carried out in a flow system in situ in a reaction chamber (Harrick) inserted into the DRIFT attachment of an infrared spectrometer (Thermo Nicolet 6700). Before the tests, the samples of the zeolite placed in the reactor were heated at 110° C. under He flow in order to desorb part of the water present in the zeolite. Sorption of the aldehyde dosed from a saturator was carried out in the reactor under He flow at a rate of 20 $cm^3$/min for 30 min at 25° C. After the sorption, and before turning the thermal programme on, the sample was blowed with He at 25° C. Analyses of transformations of the formaldehyde adsorbed on the zeolite surface were carried out at various temperatures under He flow.

The results presented in FIG. 9 A show that the ZAg0_EDTA modified zeolite exhibits a sorptivecapacity. Acetic aldehyde adsorbed on the samples already at room temperature, which is proven by the bands arising after sorption: apart from the band from methyl vibrations in the range of 3,000-2,800 $cm^{-1}$, also vibration from the aldehyde group at 1,760 and 1,728 $cm^{-1}$ (absent in the case of the reference sample). According to the correlation tables, the band corresponds to vibrations of the following moieties:

2,987 $cm^{-1}$–$v_{as}$ $CH_3$,
2,920 $cm^{-1}$–$v_s$ $CH_3$,
2,870 $cm^{-1}$–$2v_{5\ fermi}$ $CH_3$,
2,752 $cm^{-1}$–$2\delta_s$ OH (from adsorbed $CH_3OH$), or overtone band from extraplanar CH group vibration
1,728, 1,680 $cm^{-1}$–v C═O
1,411 $cm^{-1}$–$\delta_{as}$ $CH_3$
1,350 $cm^{-1}$–$\delta_s$ $CH_3$ (δ CH)

Moreover, in the range of carbonyl group vibrations of the aldehyde, a band at 1,642 $cm^{-1}$ occurs, originating from bending vibrations of $H_2O$ molecules bound in the zeolite. The band at 1,680 $cm^{-1}$ is characteristic for stretching vibrations from carboxylic groups. Depending on the local potential around the adsorbed molecule, these bands may shift.

A comparison of spectra for the presented material ZAg0_EDTA and the reference material $ZAg^+$_EDTA indicates differences in the sorptive capacity and the catalytic activity of the materials (FIGS. 9A and 9B). While analysing the evolution of the spectra with increasing temperature (FIG. 9 A), a gradual decrease in the intensity of the band from aldehyde group vibrations at 1,728 $cm^{-1}$ for both samples may be observed when the temperature increases (FIGS. 9C and 9D). The temperature increase is accompanied by not only desorption of acetic aldehyde from the surface of the sample (physisorbed portion at a low temperature), but also its oxidation, initially to acetic acid, the presence of which is indicated by the band at 1,720 and 1,680 $cm^{-1}$. Bands from carboxylic groups arise at room temperature for the sonicated sample ZAg0_EDTA and grows with the increase in temperature to 100° C. A decrease in its intensity and desorption of acetic acid then occur. It should be noticed that the bands from acetic acid for the non-sonicated sample $ZAg^+$_EDTA at room temperature do not appear, and they do not develop before 100° C., being an important difference in the oxidative properties of both materials. According to this observation, the conversion of acetic aldehyde also has a less dynamic character for this sample. Moreover, considering the fact that the material without the access of oxygen (flushing with an inert gas) exhibits an oxidative action, this indicates that the mechanism of the reaction is of the Mars-van Krevelen type, wherein lattice oxygen is used for oxidation of the adsorbate. In the given temperature range, no significant changes in the intensity of the band originating from carbon dioxide were found, testifying to incomplete oxidation of the aldehyde. Moreover, the spectra at temperatures above 200° C. are the same as before the sorption of acetaldehyde, only the band at 1,642 $cm^{-1}$ has faded, which is connected with the loss of water from the zeolite.

In an analogous experiment carried out in air as the carrier gas used instead of helium, in the thermal programme, acetic acid forms in the zeolite in a large amount already at room temperature, being a fundamental difference in comparison to the non-sonicated reference sample. The latter does not starts to oxidise acetic aldehyde to a significant degree before 100° C. (similar traces are also observed at room temperature) (comp. spectra FIGS. 10A and 10B). Carbon Dioxide Forms for both Samples at a Temperature of approx. 250° C.

A quantitative interpretation of the observed changes is shown in FIGS. 11A and 11B, where X is the degree of conversion of acetic aldehyde determined based on intensity of the band at 1,728 $cm^{-1}$ (calculated similarly as the conversion, while the maximum—initial—value of the intensity is used as a reference value), and Y is the degree of conversion of acetic acid calculated based on intensity of the band at 1,680 $cm^{-1}$ (related to the maximum value). Acetic aldehyde oxidised in air already at room temperature in the case of the sonicated sample, so the value of intensity after sorption at 25° C. without the access of air was adopted as the maximum value of intensity. The so-presented degree of conversion of acetic aldehyde includes both its reaction and desorption from the surface of the zeolite. A quantitative comparison of the sample of the sonicated zeolite ZAg0_EDTA and the non-sonicated zeolite indicates significantly higher activity of the sonicated form at significantly lower temperatures. Formation of acetic acid in air was observed already at room temperature, in the amount of 80% in relation to the maximum value. It should also be noted that the maxima of the acetic acid yield are repeated at the same temperatures for a given sample irrespective of the experimental conditions.

Acetic aldehyde is also adsorbed on samples of the final paper material (PZAg0_EDTA), shown in FIGS. 11A and 11B. Acetic aldehyde was bound in the material at a temperature of 25° C. Such a conclusion may be drawn based on characteristic bands (2,920, 1,728, 1,640 $cm^{-1}$) originating from acetaldehyde. In this case, analysis of the catalytic capacity of the material is hindered, because of the fact that the bands originating from acetaldehyde and the zeolite are concealed by the bands originating from cellulose. However, there is no reason to claim they are different.

Definition of Microbiological Activity

The studies were carried out using the following test organisms:

Bacteria:

1. *Escherichia coli*
2. *Serratia marcescens*
3. *Bacillus subtilis*
4. *Bacillus megatherium*

Fungi:

5. *Trichoderma viride*
6. *Chaetomium globosum*
7. *Aspergillus niger*
8. *Cladosporium cladosporioides*
9. *Mortierella alpinum*

The above strains are stored on nutrient media in the laboratory of the Plant-Microbial Interactions team, Institute of Environmental Sciences and the Malopolska Centre of Biotechnology, Jagiellonian University (Kraków), and are used for comparative studies after inoculating onto proper nutrient media. A part of these strains was isolated from paper, and another part was obtained during other research.

Comparison of Various Zeolite Materials

The first step of quantitative analysis of microbiological activity consisted in the testing of a series of the zeolites which could be possibly used in nanocomposite packaging. Y-type (faujasite), ZSM-5 (pentozil) zeolites and MCM-56 molecular sieves (a mesoporous material) were used for the tests. These materials were exchanged with silver cations, similarly as described for the Y-type zeolite in previous sections.

All tested materials exhibited antibacterial activity (FIGS. 10A and 10B). It should be noted that without the zeolite material (blank test), bacteria grew at a level of 9,000 counts. The worst place in the ranking of the zeolites was achieved by MCM-56 molecular sieves. The microbiological activity of the Y and ZSM-5 zeolites is close irrespective of the state of silver in the sample (samples with $Ag^{+}$ and sonicated with $Ag^{0}$). However, the Y-type zeolite proposed in this work proved to be the best from among all materials (preparation according to that described in this document). Almost a 100% antibacterial activity in the case of *Escherichia coli* bacteria was obtained for this material.

Tests of the Paper Materials with the Y-type Zeolite

The next step in determination of activity consisted in tests on finished paper sheets. Samples of the materials prepared at the Faculty of Chemistry of the Jagiellonian University were used for this test. Before the samples were used in the experiment, they were sterilised on Whatman paper in Petri dishes.

Bacteria (strains 1-4) were placed onto the surface of agar (NA) and spread using a disposable spreader (a single spreader was used for a given strain). Every strain and every type of the paper sample was tested 3-5 times (some tests were rejected because of a non-uniform spreading of the material, which is visible several days after preparation; min. N=3). Onto each Petri dish with bacteria, a single paper disk was placed. The cultures were placed at a temperature of 32° C. for three days, and then the temperature was decreased to 25° C. for the next several days. Growth of the microorganisms was observed every day. No formation of a no-growth zone around the discs of the material was found in any tested sample, proving that silver did not propagate from the tested material.

A further part of the experiment was transferred into a laminar chamber (sterile conditions). A significant decrease in bacteria growth under the discs with an addition of silver (in every form) was found. Every Petri dish was opened, and on the reverse side of its upper part, a paper disc was placed using a sterile pincette by turning it upside-down and thus exposing the part which was adjacent to the agar. A LuciPac Pen (ATP+AMP Hygiene Monitoring test kit from Kikkoman Corp. code 60331) was used for evaluation of bacterial populations, following recommendations, with minute innovations. The swab was positioned perpendicularly to the disc in its central part, and by leaning its tip against the disk in a "screwdriver position", it was turned by 360°. The result defining a relative ATP+AMP content was then read from the lumitester reader.

Fungi (strains 5-9) were introduced onto Petri dishes containing a PDA nutrient medium, and three filters of each type were placed centrally onto each dish. In each case, the test was carried out in triplicate. The strains were introduced in the form of an agar disc with mycelium at a distance of 2 cm from the central disc. Due to the various rate of mycelium growth, it was necessary to carry out the test for a prolonged time (approx. 2 weeks). Each of the tested strains exhibited slightly different problems during observation.

*Trichoderma viride*—formed colonies with spores in a circular area of the colony's exterior; in some cases, the disc was found in the wrong place, hindering observations. In some cases, a delay in maturation of conidia was observed, manifested with their lighter colour—light green or yellow (outside this area, the conidia were blue-green).

*Chaetomium globosum*—formation of fruit bodies was generally delayed on the surface of the paper samples used, wherein the activity of the mycelium was probably focused on decomposition of the paper, while fructification constitutes a sign of lack of nutritive compounds.

*Aspergillus niger*—is suitable for rapid tests, although spores freed from the surrounding conidiophores appeared on the surface of the discs with silver during the test, slightly hindering the analyses; however, no such conidia grew in such places, although they probably maintained their viability.

*Cladosporium cladosporioides*—a species characterised by relatively slow growth; it was necessary to place the inoculum on the dishes again in order to accelerate the mycelium reaching the discs; formation of black mycelium (visible within the paper discs in cases when colonisation of the paper occurred) is an advantage of this species.

*Mortierella alpina*—light mycelium with conidia containing no dark pigments.

The results presented in FIGS. 11A, 11B, and 12 show that the paper packed with the zeolite substituted with silver cations, and then sonicated and rinsed with EDTA (PZAg0_EDTA), exhibits better biocidal properties against bacteria and is slightly better in the case of antifungal activity when compared to the reference sample in the non-sonicated form ($PZAg^{+}$_EDTA), particularly in the case of *Chaetomium* and *Cladosporium fungi.*

Summary Relating to the Developed Material

Taking into account such parameters as: silver content in paper preparations, stability of the paper, sorptive and catalytic properties, the PZAg0_EDTA paper material with the sonicated Y-type zeolite exchanged with silver significantly enriches the expected assumptions for packaging. Based on optimisation of the silver content, a material containing less than 1% by wt. of silver was chosen for physico-chemical studies. This is the lowest value for which biocidal activity against all tested organisms was observed. The proposed material has a hybrid character, in which the active agent is in the form containing both cations and reduced silver bound in the zeolite matrix. The sorptive properties of the material confirmed for carbon monoxide and acetic aldehyde are noteworthy. Another advantage of the material consists in its ability to catalyse oxidation reactions at room temperature without the access of air, which has been ascertained in the example of acetic aldehyde oxidation. High biocidal activity was confirmed in tests with selected strains of microorganisms typically occurring in food and archival materials. A relatively lower microbiocidal capacity was found for *Bacillus megaterium* bacteria and *Aspergillus* fungi.

The invention claimed is:

1. A composite material comprising cellulose packed with silver-containing zeolite of a Y-type, which is a mineral filler, whereas silver occurs in a form that is entirely bound to the zeolite and in the form of both silver cations and reduced silver, wherein the silver content not exceeding 2 wt. %, and the material exhibits antimicrobial, sorptive, and catalytic properties, wherein the reduced silver is silver having an oxidation state of zero.

2. A material according to claim 1 characterised in that the silver cations are introduced to the zeolite by ion exchange.

3. A material according to claim 1 characterised in that the reduced silver occurs in the zeolite as a result of sonication.

4. A material according to claim 1 characterised in that the zeolite has exclusively exchanged silver and no silver in a non-bound form.

5. A material according to claim 1 characterised in that the material exhibits sorptive properties towards volatile organic compounds or gaseous impurities, or both.

6. A material according to claim 1 characterised in that the material exhibits catalytic properties in oxidation of volatile organic compounds at room temperature in air and at a temperature of above 60° C. without air access.

7. A material according to claim 1 characterised in that the material exhibits bactericidal properties against *Escherichia coli, Serratia marcescens, Bacillus subtilis* or *Bacillus megatherium* bacteria.

8. A material according to claim 1 characterised in that the material exhibits fungicidal properties against *Trichoderma viride, Chaetomium globosum, Aspergillus Niger, Cladosporium cladosporides* and *Morterella alpinum* fungi.

9. A packaging material comprising the composite material of claim 1.

10. The packaging material according to claim 9, wherein said packaging material is for plants, works of art, archives or antique objects.

11. The packaging material according to claim 9, wherein said packaging material is for food, pharmaceuticals or animal fodder.

12. The material of claim 1, wherein said silver cations and said reduced silver are present in a ratio of 1:1.

13. A method for production of a composite material of claim 1, said method comprising the substitution of a zeolite with both silver(I) ions and a reduced form of metallic silver to obtain a modified zeolite, addition of said modified zeolite to a cellulose suspension with cellulose fibres, formation of the paper pulp into a desired shape and drying said paper pulp, wherein the modified zeolite is rinsed with an aqueous solution of disodium salt of ethylenediaminetetraacetic acid (EDTA).

14. The method according to claim 13 characterised in that before rinsing with EDTA, said method comprising sonication of the modified zeolite.

15. The method of claim 14, wherein said sonication comprises sonicating for at least 10 minutes in a suspension of the modified zeolite, and at a temperature of below 60 ° C.

16. The method of claim 13, wherein said rinsing with EDTA comprises the following steps: a) rinsing of the zeolite with 0.01 M EDTA at room temperature; b) washing for one hour at boiling temperature with the 0.01 M EDTA; c) rinsing of the zeolite with of 0.1 M EDTA solution and d) flushing of the zeolite with deionised water.

* * * * *